US012372295B2

(12) United States Patent
Lee

(10) Patent No.: US 12,372,295 B2
(45) Date of Patent: Jul. 29, 2025

(54) REFRIGERATOR AND HOME APPLIANCE

(71) Applicant: LG Electronics Inc., Seoul (KR)

(72) Inventor: Jonghwa Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 138 days.

(21) Appl. No.: 18/091,709

(22) Filed: Dec. 30, 2022

(65) Prior Publication Data

US 2023/0213270 A1 Jul. 6, 2023

(30) Foreign Application Priority Data

Dec. 31, 2021 (KR) ..... 10-2021-0194293
Dec. 31, 2021 (KR) ..... 10-2021-0194298

(51) Int. Cl.
*F25D 23/02* (2006.01)
*F25D 11/00* (2006.01)
*F25D 23/10* (2006.01)

(52) U.S. Cl.
CPC ..... *F25D 23/028* (2013.01); *F25D 11/00* (2013.01); *F25D 23/10* (2013.01); *F25D 2323/02* (2013.01); *F25D 2400/18* (2013.01)

(58) Field of Classification Search
CPC ..... F25D 11/00; F25D 23/02; F25D 23/028; F25D 23/10; F25D 2323/02; F25D 2400/18
USPC ..... 312/405
See application file for complete search history.

(56) References Cited

U.S. PATENT DOCUMENTS

| | | | | |
|---|---|---|---|---|
| 4,949,520 | A | 8/1990 | Bear | |
| 5,358,326 | A | 10/1994 | Cherry et al. | |
| 5,571,276 | A | 11/1996 | Kobos et al. | |
| 5,603,557 | A | 2/1997 | Marks et al. | |
| 6,557,956 | B2 | 5/2003 | Hightower | |
| 6,722,083 | B2 * | 4/2004 | Herrmann | F25D 23/02 52/204.63 |
| 7,178,886 | B2 | 2/2007 | Hightower | |
| 7,866,773 | B2 * | 1/2011 | Leimkuehler | F25D 23/02 62/449 |
| 7,954,345 | B2 | 6/2011 | Park | |

(Continued)

FOREIGN PATENT DOCUMENTS

| | | |
|---|---|---|
| CN | 113446788 | 9/2021 |
| CN | 113865232 | 12/2021 |

(Continued)

OTHER PUBLICATIONS

Office Action in Korean Appln. No. 10-2021-0194293, mailed on Nov. 28, 2023, 10 pages (with English translation).

(Continued)

*Primary Examiner* — James O Hansen
(74) *Attorney, Agent, or Firm* — Fish & Richardson P.C.

(57) ABSTRACT

A appliance includes: a cabinet defining define a storage space, and a door configured to open and close the storage space. The door comprises a door body, a door panel defining a front surface of the door, a cap decoration defining a lower surface of the door body, and a bracket provided at a rear surface of the door panel and configured to be coupled to the cap decoration. The bracket comprises a buffer rib protruding from a first surface of the bracket and configured to, based on the bracket being coupled to the cap decoration, define a space between the bracket and the cap decoration.

17 Claims, 27 Drawing Sheets

(56) References Cited

U.S. PATENT DOCUMENTS

| | | | | |
|---|---|---|---|---|
| 8,485,615 | B2 | 7/2013 | Ciyanoglu et al. | |
| 9,810,475 | B2 * | 11/2017 | Kim | F25D 23/02 |
| 10,907,884 | B1 | 2/2021 | Scorsim et al. | |
| 11,029,079 | B1 | 6/2021 | Lee et al. | |
| 11,047,613 | B1 | 6/2021 | Park et al. | |
| 11,320,192 | B2 | 5/2022 | Lee et al. | |
| 11,402,147 | B2 | 8/2022 | Lee et al. | |
| 2004/0194253 | A1 * | 10/2004 | Jung | F25D 23/02 16/87.2 |
| 2007/0188059 | A1 | 8/2007 | Davis et al. | |
| 2012/0169196 | A1 | 7/2012 | Marchetti | |
| 2016/0341468 | A1 | 11/2016 | Joo et al. | |
| 2017/0370631 | A1 | 12/2017 | Kim et al. | |
| 2018/0187955 | A1 | 7/2018 | Son et al. | |
| 2020/0072544 | A1 | 3/2020 | Lee et al. | |
| 2020/0284503 | A1 | 9/2020 | Gerstmayr et al. | |
| 2020/0323342 | A1 | 10/2020 | Chavan et al. | |
| 2020/0326119 | A1 | 10/2020 | Lee et al. | |
| 2021/0055038 | A1 | 2/2021 | Lee et al. | |
| 2021/0071934 | A1 | 3/2021 | Lee et al. | |
| 2021/0372688 | A1 | 12/2021 | Kang et al. | |
| 2021/0396456 | A1 | 12/2021 | Park et al. | |
| 2021/0396458 | A1 | 12/2021 | Moon et al. | |
| 2022/0003494 | A1 | 1/2022 | Kwon et al. | |

FOREIGN PATENT DOCUMENTS

| | | | | |
|---|---|---|---|---|
| EP | 3809072 | A1 | 4/2021 | |
| JP | H0791816 | A | 4/1995 | |
| JP | 2016-156556 | A | 9/2016 | |
| JP | 6460832 | | 1/2019 | |
| KR | 10-1124410 | | 3/2012 | |
| KR | 10-1520691 | | 5/2015 | |
| KR | 10-2021-0156165 | | 12/2021 | |
| WO | WO 2014/024429 | A1 | 2/2014 | |
| WO | WO 2021033977 | * | 2/2021 | F25D 23/02 |
| WO | WO 2021/112658 | A1 | 6/2021 | |
| WO | WO 2021/172948 | | 9/2021 | |

OTHER PUBLICATIONS

Extended Search Report in European Appln. No. 22183537.4, dated Nov. 25, 2022, 8 pages.

Office Action in Australian Appln. No. 2022204877, mailed on Jun. 30, 2023, 6 pages.

Extended Search Report in European Appln. No. 22217371.8, mailed on May 4, 2023, 9 pages.

Office Action in U.S. Appl. No. 17/859,457, mailed on Jun. 8, 2023, 11 pages.

* cited by examiner

REFRIGERATOR AND HOME APPLIANCE

CROSS-REFERENCE TO RELATED APPLICATIONS

The present application claims priority under 35 U.S.C. 119 and 35 U.S.C. 365 to Korean Patent Application No. 10-2021-0194293, filed on Dec. 31, 2021, and Korean Patent Application No. 10-2021-0194298, filed on Dec. 31, 2021, which are hereby incorporated by reference in their entirety.

BACKGROUND

The present disclosure relates to a refrigerator and a home appliance.

In general, home appliances are disposed in an indoor space and may be disposed to be harmonized with the surrounding space. In addition, to further improve the appearance of the home appliance, a panel defining an outer appearance on a front surface of the home appliance may be provided.

Typically, structures that variously modify the outer appearance of the front surface of the refrigerator so as to be harmonized with environments in which the refrigerator is placed, surrounding furniture, or other home appliances are being developed, and this trend is being made throughout the home appliances.

In order to harmonize with an environment in which the refrigerator is disposed or with surrounding furniture or home Machine, structures for varying an outer appearance of a door front of the refrigerator are developed, and this trend is the same throughout the home appliance.

A structure in which a panel defining the outer appearance of the front surface of the door of the refrigerator is mounted is disclosed in Japanese Patent No. 6460832.

However, in such a technology according to the related art, it is not easy to attach or detach a glass panel in a state of being mounted, and thus, it is difficult to change an outer appearance of a front surface of a door according to the consumer's preference.

SUMMARY

Embodiments provide a refrigerator a refrigerator, in which a panel is capable of being separately mounted on a door to improve an outer appearance, and a home appliance.

Embodiments provide a refrigerator, in which a panel is easily detachable, and a home appliance.

Embodiments provide a refrigerator which is maintained in a state, in which a panel is firmly mounted, and a home appliance.

Embodiments provide a refrigerator including a door having improved aesthetics, rigidity, and durability and a home appliance.

In one embodiment, The home appliance comprising: a cabinet configured to define a storage space; a door configured to open and close the storage space; wherein the door comprises: a door body; a door panel configured to define a front surface of the door; a cap decoration configured to define a lower surface of the door body; and a bracket provided on a rear surface of the door panel and coupled to the cap decoration; wherein the bracket comprises a buffer rib protruding from one surface of the bracket to form a space between the bracket and the cap decoration.

The cap decoration includes a restriction portion protruding upward. The bracket includes a mounting portion having a space into which the restriction portion is inserted.

The cap decoration is bent to extend from one surface and comprise a seating portion on which the plurality of restriction portions are disposed. The buffer rib is in contact with the seating portion in the state in which the panel bracket is mounted on the cap decoration.

The mounting portion comprising a body portion formed spaced apart from the front surface of the bracket; a connecting portion extending from both side ends of the body toward the front; and an opening into which the restraining part is inserted.

In a state in which the restriction portion is inserted into the mounting portion, the body portion is maintained in the state of being spaced apart from the seating portion.

The mounting portion extend along the left and right direction in which the body portion extends and comprise a hook protrusion protruding in the direction of the cap decoration. The hook protrusion is in contact with a front surface of the cap decoration.

The bracket comprise a partition portion is disposed inside the mounting portion and connecting the front surface of the bracket and the body portion.

The bracket comprise an inclined portion that is inclined toward the door panel from at the lower end of bracket. The cap decoration comprise a decoration inclined portion disposed to match the inclined portion at a position corresponding to the inclined portion.

The bracket comprise round portion formed to be rounded from one end of the inclined portion toward the door panel. The round portion configured to define at least a part of the front surface of the door.

The bracket comprise a coupling part coupled to the door panel on the front side, and an accommodation groove formed by being recessed backward at one end of the coupling part. a plurality of ribs are arranged in the accommodating groove in the left-right direction in which the panel bracket extends.

The door panel is bent backward at one end to form a bending portion, and the bending portion is inserted between the accommodation groove and the rib.

The bracket further comprise a bracket rib protruding rearward from a rear surface of the bracket and extending in a direction in which the mounting portion extends.

The door comprises a upper bracket on which a mounting protrusion provided on a rear surface of the plate to protrude backward is disposed, a upper cap decoration having a protrusion accommodation portion that is opened forward so that the mounting protrusion is inserted therein and a decoration cover mounted on the cap decoration to define an outer surface of the cap decoration. The decoration cover is mounted in a direction crossing an insertion direction of the mounting protrusion to restrict the protrusion accommodation portion that is in the state in which the mounting protrusion is inserted.

A decoration opening is defined in the cap decoration, and the decoration cover has a shape that shields the decoration opening.

A pair of restriction portions extending to an inside of the decoration opening are disposed on the decoration cover, and the protrusion accommodation portion and the mounting protrusion are restricted between the pair of restriction portions.

The protrusion accommodation portion is elastically deformable in the direction crossing the insertion direction of the mounting protrusion, and the restriction portion is configured to restrict an outer surface of the protrusion accommodation portion so as to limit the deformation of the elastic deformation of the protrusion accommodation portion.

The protrusion accommodation portion is constituted by a pair of accommodation members spaced apart from each other, and the accommodation members extend forward and are spaced an interval, at which the mounting protrusion is capable of being press-fitted, from each other.

The mounting protrusion comprises an extension portion extending backward from a rear surface of the bracket; and an insertion portion disposed on an end of the extension portion and having a width greater than a thickness of the extension portion so as to be inserted between the pair of accommodation members.

The insertion portion has a width that gradually decreases as the insertion portion protrudes backward.

Each of the accommodation member comprises an inlet portion configured to define an inlet, into which the insertion portion is inserted, the inlet portion extending outward as the inlet portion extends forward; and a fixing portion disposed on a rear end of the inlet portion and having a shape corresponding to an outer surface of the insertion portion to surround the outer surface of the insertion portion.

In one embodiment, a home appliance includes: a main body configured to define a storage space; a door configured to open and close the storage space and including a door body and a door panel mounted on the door body, wherein the door panel includes: a plate configured to define a front surface of the door; and a bracket on which a mounting protrusion provided on a rear surface of the plate to protrude backward is disposed, wherein the door body includes: a cap decoration having a protrusion accommodation portion that is opened forward so that the mounting protrusion is inserted therein; and a decoration cover mounted on the cap decoration to define an outer surface of the cap decoration, wherein the decoration cover is mounted in a direction crossing an insertion direction of the mounting protrusion to restrict the protrusion accommodation portion that is in the state in which the mounting protrusion is inserted.

A decoration opening may be defined in the cap decoration, and the decoration cover may have a shape that shields the decoration opening.

A pair of restriction portions extending to an inside of the decoration opening may be disposed on the decoration cover, and the protrusion accommodation portion and the mounting protrusion may be restricted between the pair of restriction portions.

A restriction portion accommodation groove in which a lower end of the restriction portion is accommodated may be defined in the decoration opening.

The protrusion accommodation portion may be elastically deformable in the direction crossing the insertion direction of the mounting protrusion, and the restriction portion may be configured to restrict an outer surface of the protrusion accommodation portion so as to limit the deformation of the elastic deformation of the protrusion accommodation portion.

The protrusion accommodation portion may be constituted by a pair of accommodation members spaced apart from each other, and the accommodation members may extend forward and be spaced an interval, at which the mounting protrusion is capable of being press-fitted, from each other.

The mounting protrusion may include: an extension portion extending backward from a rear surface of the bracket; and an insertion portion disposed on an end of the extension portion and having a width greater than a thickness of the extension portion so as to be inserted between the pair of accommodation members.

The insertion portion may have a width that gradually decreases as the insertion portion protrudes backward.

Each of the accommodation member may include: an inlet portion configured to define an inlet, into which the insertion portion is inserted, the inlet portion extending outward as the inlet portion extends forward; and a fixing portion disposed on a rear end of the inlet portion and having a shape corresponding to an outer surface of the insertion portion to surround the outer surface of the insertion portion.

A distance between the inlet portions disposed at both sides may be less than a width of the insertion portion, and a distance between the insertion portions disposed at both sides may be greater than the distance between the inlet portions and equal to or less than the width of the insertion portion.

A restriction portion accommodation groove into which a lower end of the restriction portion is inserted may be defined in each of both sides of the pair of accommodation members.

A distance between the pair of restriction portions may correspond to a distance between outer surfaces of the protrusion accommodation portion, and an inner surface of each of the pair of restriction portions may be in contact with each of the outer surface of the protrusion accommodation portion to restrict the protrusion accommodation portion.

An inclined surface having an inclination toward the outer surface of the protrusion accommodation portion as at least a portion of the inclined surface faces an upper side may be defined on an inner surface of the restriction portion.

An upper portion of the restriction portion, which is in contact with the outer surface of the protrusion accommodation portion, may be disposed on an inner surface of the restriction portion, and a lower portion of the restriction portion, which is spaced apart from the protrusion accommodation portion and inserted into the restriction portion accommodation groove, may be disposed on the inner surface of the restriction portion.

A plurality of reinforcing ribs disposed in an extension direction of the restriction portion may be disposed on an outer surface of the restriction portion.

A mounting guide extending backward between the plurality of mounting protrusions may be disposed on a rear surface of the bracket, and a seating portion stepped to support the mounting guide at a lower side in the state in which the mounting protrusion is inserted into the protrusion accommodation portion may be disposed on the cap decoration.

A cover coupling portion coupled to the cap decoration may be disposed on the decoration cover, and the cover coupling portion may be coupled to a hinge mounting portion to which a hinge configured to rotate the door is mounted.

The cap decoration may include: an upper decoration configured to define an upper portion of the door body; and a lower decoration configured to define a lower portion of the door body, and the protrusion accommodation portion may be defined in the upper decoration.

The bracket may include: an upper bracket which is provided on a lower portion of a rear surface of the plate and on which the mounting protrusion is disposed; and a lower bracket provided on the lower portion of the rear surface of the plate and coupled to the lower decoration.

A lower end support portion extending forward to support the panel at the lower side may be disposed on a lower end of the lower cap decoration, a hook protrusion protruding upward may be disposed on the lower end support portion, and a lower mounting portion opened downward so that the hook protrusion is inserted therein may be disposed on the lower bracket.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a front surface of a door, which is illustrated in FIG. 1, i.e., a direction in which a door panel is disposed may be defined as a front direction, a rear surface of the door, i.e., a direction in which a door liner is disposed may be defined as a rear direction, a direction toward a bottom surface, on which a refrigerator is installed, may be defined as a downward direction, and a direction away from the bottom surface may be defined as an upward direction.

Figure 1:
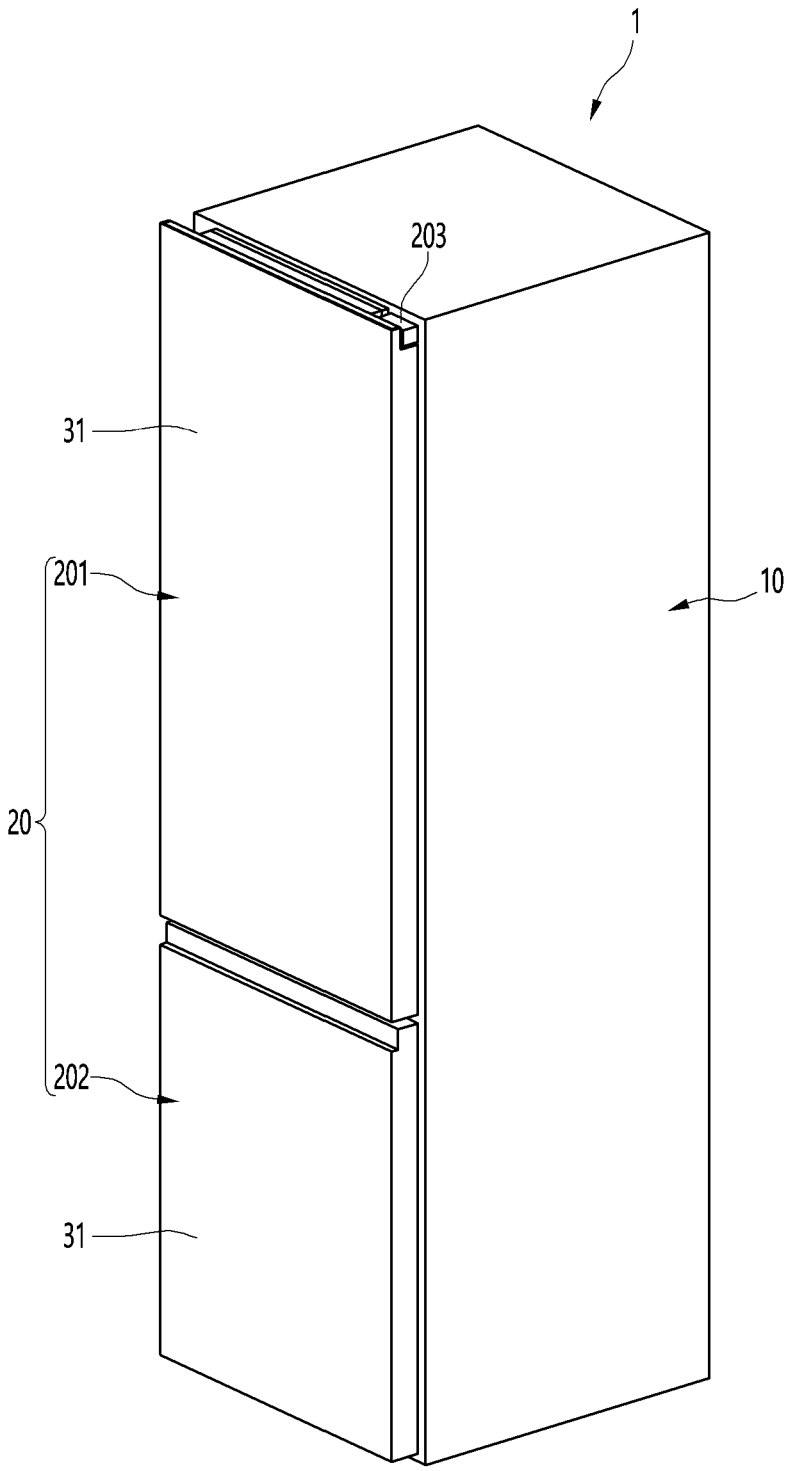
FIG. 1 is a perspective view of a refrigerator according to an embodiment.

FIG. 1 is a perspective view of a refrigerator according to an embodiment.

A refrigerator 1 according to an embodiment includes a cabinet 10 defining a storage space and a door 20 disposed in front of the opened cabinet to open and close the storage space.

The storage space may be partitioned into multiple spaces as necessary. For example, the storage space of the refrigerator 1 may be partitioned vertically and may include an upper storage space 11 and a lower storage space 12. Although not limited thereto, a refrigerating compartment may be defined in the upper storage space 11, and a freezing compartment may be defined in the lower storage space 12.

The door 20 may include an upper door 201 and a lower door 202, which open and close the upper storage space 11 and the lower storage space 12. The upper door 201 and the lower door 202 may be configured to open and close the storage spaces 11 and 12 by rotation, respectively.

In an embodiment, for convenience of description and understanding, the refrigerator in which the door 20 is provided singly on each of upper and lower portions of a front surface of the cabinet has been described, but the embodiment is not limited thereto. For example, this embodiment may be applied to all types of refrigerators such as a refrigerator, in which each of the upper door 201 and the lower door 202 is provided as a pair or is opened and closed in draw in and out of a drawer.

A front surface of the door 20 is defined by a panel 30. In addition, the panel 30 may define an overall outer appearance of the front surface of the refrigerator.

Hereinafter, a structure of the door 20 will be described in more detail.

Figure 2:
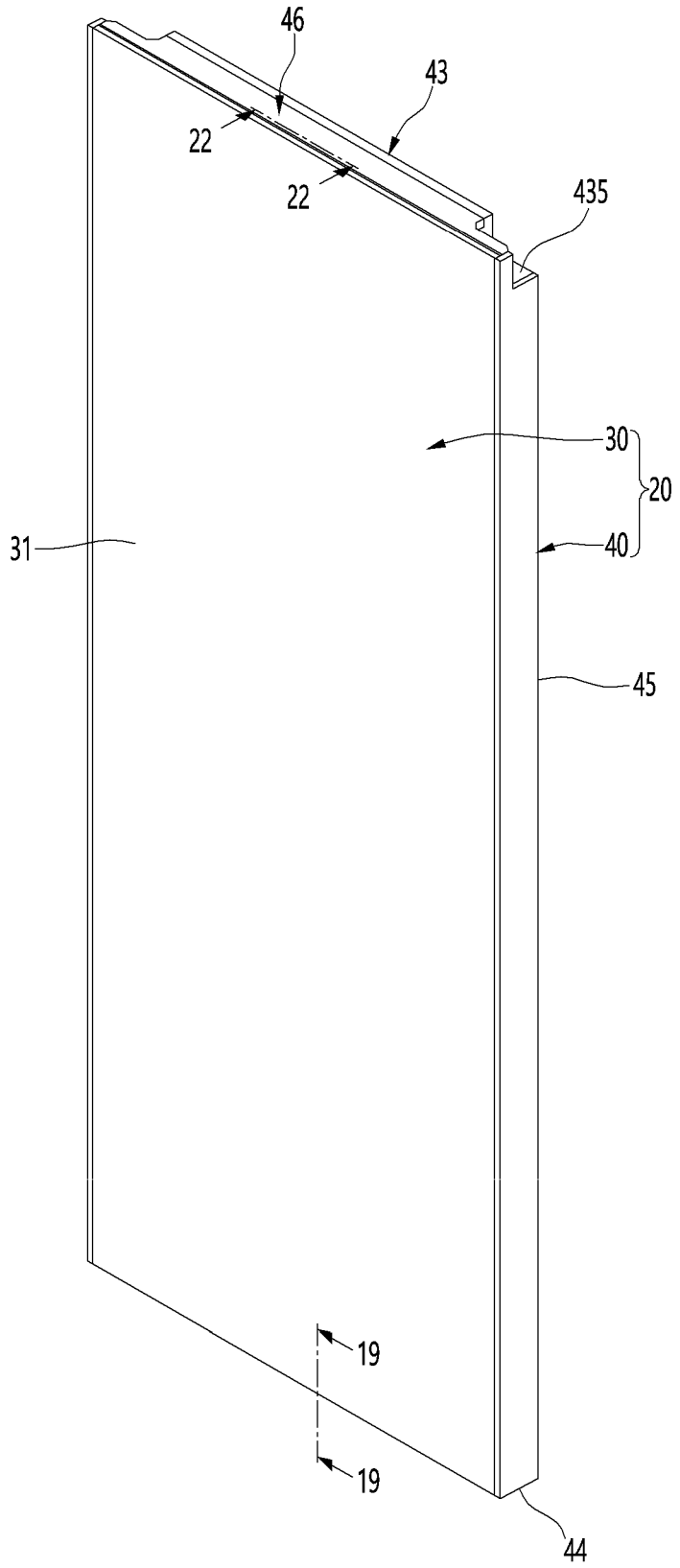
FIG. 2 is a perspective view illustrating a door of the refrigerator.
Figure 3:
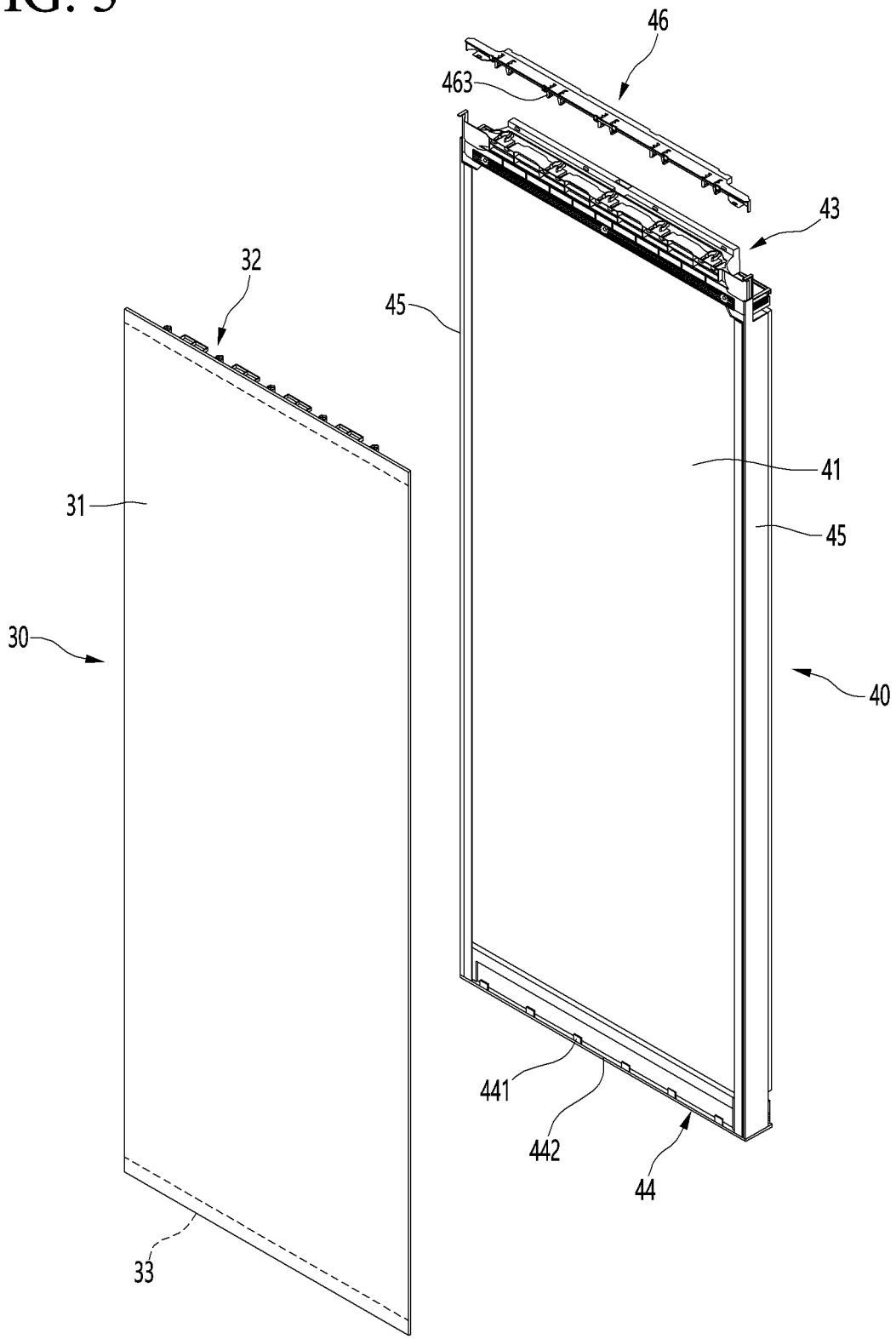
FIG. 3 is a perspective view illustrating a state in which a panel of the door and a door body are separated from each other according to an embodiment.
Figure 4:
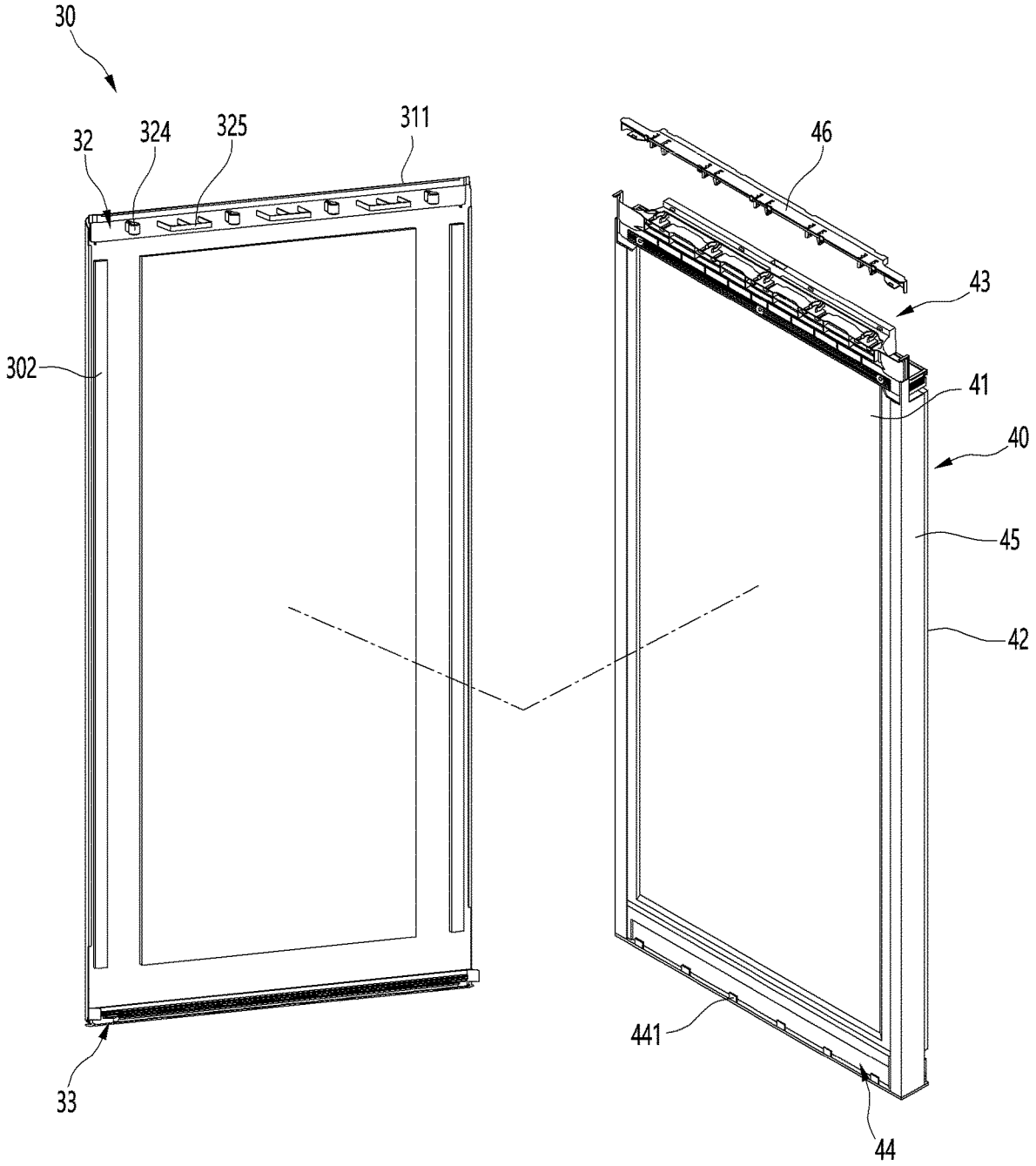
FIG. 4 is a view illustrating a state in which the door is divided into the door body and the door panel according to an embodiment.
Figure 5:
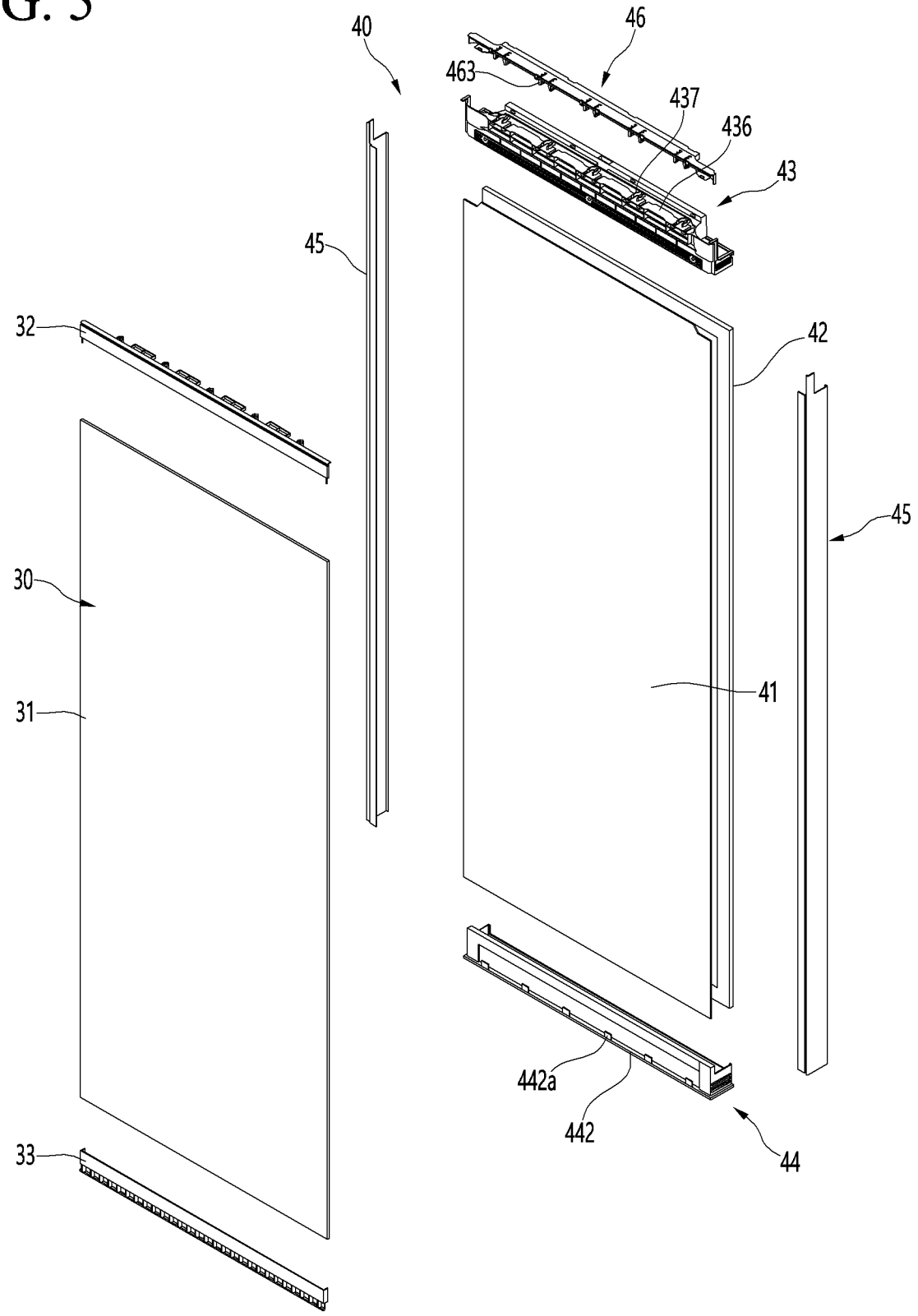
FIG. 5 is an exploded perspective view of the door.

FIG. 2 is a view illustrating a state in which the door is divided into the door body and the door panel according to an embodiment. Also, FIG. 3 is an exploded perspective view of the door. Also, FIG. 4 is a view illustrating a state in which the door is divided into the door body and the door panel according to an embodiment. Also, FIG. 5 is an exploded perspective view of the door.

As illustrated in the drawings, the door 20 includes a door body 40, which opens and closes the storage space, and a panel 30 coupled to the door body 40 to define an outer appearance of the front surface of the door 20.

The door body 40 may define an overall shape of the door 20 and may play a role of substantially opening and closing and insulating the storage space.

The door body 40 may include a body plate 41 defining a front surface, a door liner 42 defining a rear surface, and a cap decoration defining a portion of a circumferential surface of the door body.

The cap decoration may include an upper cap decoration 43 defining a top surface of the door body 40 and a lower cap decoration 44 defining a bottom surface of the door body 40. The door body 40 may further include a side decoration 45 defining both right and left surfaces of the door body 40.

The body plate 41 may define the shape of the front surface of the door body 40. The body plate 41 may be provided in a metal plate shape and may be made of an iron plate material to which a magnet 302 is capable of being attached. A circumference of the body plate 41 may be coupled to the upper cap decoration 43, the lower cap decoration 44, and the side decoration 45.

The door liner 42 may be made of a plastic material and may define a bottom shape of the door 40.

The upper cap decoration 43 may be coupled to upper ends of the body plate 41 and the door liner 42 and may define an upper portion including the top surface of the door body 40. The upper cap decoration 43 may have a protrusion accommodation portion 437 that is capable of being coupled to the upper bracket 32 of the panel 30 when the panel 30 is mounted.

A decoration opening 346 recessed downward may be defined in the top surface of the upper cap decoration 43. Electrical components may be accommodated in the decoration opening 346. For example, the electrical components may include various devices, which are capable of being accommodated in the decoration opening 346, such as a sensor device for user's detection, a microphone for detecting a user's voice, a speaker that outputs sound, a door opening device that is capable of automatically opening the door 20.

The decoration opening 346 may be opened toward the upper side of the upper cap decoration 43, and the opened top surface of the decoration opening 346 may be shielded by the decoration cover 46. The decoration cover 46 may be mounted on the upper cap decoration 43 to shield the decoration cover 46. The decoration cover 46 may be coupled to the upper cap decoration 43 to define a top surface of the door body 40.

A restriction portion 463 that restricts the protrusion accommodation portion 437 may protrude downward from the decoration cover 46.

A hinge mounting portion 435 may be disposed on one end of the upper cap decoration 43. The door 20 and the hinge device 203 may be mounted on the hinge mounting portion 435.

The structures of the upper cap decoration 43 and the decoration cover 46 will be described in more detail below.

The lower cap decoration 44 may be coupled to a lower end of each of the body plate 41 and the door liner 42 and may define a lower portion including the bottom surface of the door body 40.

The lower cap decoration 44 may protrude forward to provide a lower support portion 442 that supports a lower end of the panel 30. Also, a hook protrusion 441 coupled to the lower bracket 33 may be disposed on the lower support portion 442.

The side decorations 45 may connect both left and right ends of the body plate 41, the door liner 42, the upper cap decoration 43, and the lower cap decoration 44 to each other. The side decoration 15 may define an outer appearance of each of both the left and right surfaces of the door body 40.

The side decoration 45 may protrude more forward than that the body plate 41 to support both the left and right ends of the panel 30 when the panel 30 is mounted.

An inner space defined by coupling the body plate 41, the door liner 42, the upper cap decoration 43, the lower cap decoration 44, and the side cap decoration 45 may be filled with an insulating material 400.

The panel 30 may define the outer appearance of the front surface of the door 20 and may have a structure that is capable of being attached to or detached from the door body 40 as necessary. For example, the panel 30 may be manufactured to have various colors or textures and may be selectively mounted on the door body 40 according to the user's preference. In addition, the outer appearance of the refrigerator 1 may be changed by replacing and installing the panel 30.

The panel 30 may include a plate 31 defining an outer appearance and a bracket provided on a rear surface of the plate 31 to allow the panel 30 to be mounted on the door body 40. The bracket may include at least one of the upper bracket 32 or the lower bracket 33.

Hereinafter, the structure of the panel 30 will be described in more detail with reference to the drawings.

Figure 6:
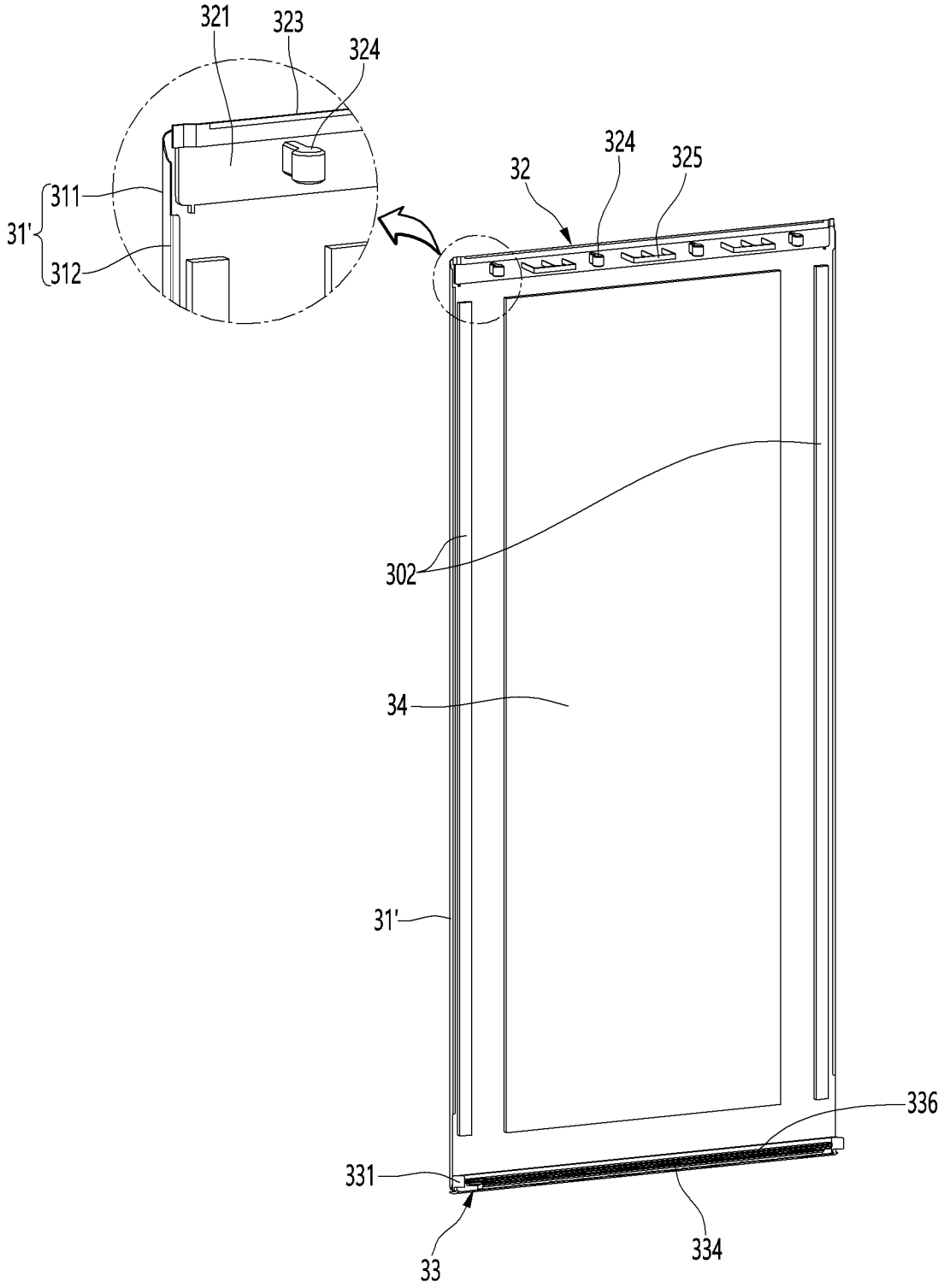
FIG. 6 is a rear perspective view of the panel.

FIG. 6 is a rear perspective view of the panel.

As illustrated in the drawing, the panel 30 may include a plate-shaped plate 31 and an upper bracket 32 and a lower bracket 33, which are provided at upper and lower surfaces of a rear surface of the plate 31, respectively.

The plate 31 may be made of a plate-shaped metal material. For example, the plate 31 may be made of a stainless steel plate material.

The plate 31 may include a panel front surface portion 311 defining an outer appearance of the front surface thereof and a bending portion 312 bent backward along a circumference of the panel front surface portion 311.

The bending portion 312 may be disposed along both upper and lower ends and both left and right ends of the panel front surface portion 311.

The plate 31 may be provided in a rectangular shape to define the front surface of the door 20 or may be provided in a flat shape. The plate 31 may be provided in a size corresponding to a size of the entire front surface of the door 20 and thus may define an overall shape and outer appearance of the front surface of the door 20.

In addition, in the bending portion 321, the bending portions 312 disposed on the upper and lower ends of the panel front surface portion 311 may be inserted into and fixed to an upper accommodation groove 322 of the upper bracket 32 and a lower accommodation groove 332 of the lower bracket, respectively.

In detail, the bending portion 312 may be disposed on the lower end of the plate 31, and the bending portion 312 may be inserted into the lower accommodation grove 332.

A lower rib 342 protruding downward to restrict the bending portion 312 may be disposed inside the lower accommodation grove 332. The bending portion 312 may be inserted between a bottom surface of the lower accommodation grove 332 and a lower end of the lower rib 342.

The bending portion 312 may be supported by a lower end support portion 333 below the lower accommodation grove 332. The lower end support portion 333 may protrude forward from a lower end of the lower accommodation grove 332 and may protrude up to the panel front surface portion 311. Therefore, in a state in which the plate 31 is mounted, the lower end of the plate 31 may be fixed in a state of being supported by the lower end support portion 333, and the outer appearance of the lower end of the panel 30 may be defined by the lower end support portion 333.

In the bending portions 312, the bending portions 312 disposed along both side surfaces of the panel front surface portion 311 may be in contact with the side decoration 45.

Alternatively, the plate 31 may be made of a tempered glass material and may be provided to have a color and texture to define the front surface of the door 20, i.e., the outer appearance of the front surface of the refrigerator 1.

The upper bracket 32 may be provided on an upper end of the plate 31. The upper bracket 32 may have a length corresponding to a horizontal length of the panel 30. The upper bracket 32 may be attached to an upper end of a rear surface of the plate 31.

The upper end of the upper bracket 32 may protrude more than the upper end of the plate 31, support the upper end of the plate 31 to protect the upper end of the plate 31, and define an outer appearance of the upper end of the panel 30.

A mounting protrusion 324 protruding backward may be disposed on a rear surface of the upper bracket 32. The mounting protrusion 324 is coupled to the protrusion accommodation portion 437 of the upper cap decoration 43 so that the panel 30 is fixedly mounted on the door body 40.

A mounting guide 325 protruding backward may be further disposed on the rear surface of the upper bracket 32. The mounting guide 325 may be seated on the upper cap decoration 43 when the panel 30 is mounted.

The upper bracket 32 may define an upper end of the panel 30 and have a function of allowing the panel 30 to be mounted on the door body 40. The upper bracket 32 may be referred to as a first bracket.

The lower bracket 33 may be provided on a lower end of the rear surface of the plate 31. The lower bracket 33 may have a length corresponding to a horizontal length of the plate 31.

The lower bracket 33 may be coupled to the lower cap decoration 44 to restrict the lower end of the panel 30. The lower bracket 33 may define an outer appearance of a lower end of the panel 30 and support the lower end of the plate 31. The lower bracket 33 may be referred to as a second bracket to be distinguished from the first bracket.

The lower bracket 33 may include a lower coupling portion 331, a lower end support portion 333, and a lower mounting portion 35.

The lower coupling portion 331 may be provided in a planar shape and may be closely attached to the rear surface of the panel 31. An adhesive member such as adhesive or double-sided tape may be provided on the lower coupling portion 331 and mounted on the rear surface of the plate 31.

The lower end support portion 333 may protrude up to a position corresponding to the front surface of the plate 31. Thus, the lower end support portion 333 may define the outer appearance of the lower portion of the panel 30 while supporting the lower portion of the plate 31. The lower end support portion 333 may support the lower end of the plate 31 to restrict downward movement of the plate 31 and simultaneously may protect the lower end of the panel 31 from being damaged by an impact.

The lower mounting portion 35 may protrude backward from the rear surface of the lower coupling portion 331. The lower mounting portion 35 may protrude at a position corresponding to the restriction portion 441 disposed on the lower cap decoration 44. A bottom surface of the lower mounting portion 35 may be opened so that the restriction portion 441 is inserted and hooked to be restricted. The hook protrusion 441 may also be referred to as a restriction portion or a lower restriction portion.

The bracket rib 355 may be disposed on a rear surface of the lower coupling portion 331. The bracket ribs 355 may protrude more than the lower mounting portion 35 and may be provided in plurality along an extending direction of the lower coupling portion 331. Thus, when the panel 30 is mounted, the bracket ribs 355 may be in contact with the front surface of the door body, and the lower bracket 33 may be supported from the rear side. The bracket rib 355 may also be referred to as a support rib.

The panel 30 may further include a buffer member 34. The buffer member 34 may be attached to the rear surface of the plate 31 and may be made of an elastic material. In addition, when the panel 30 is mounted on the door body 40, an impact applied to the panel 30 may be alleviated by being in contact with the body plate 41.

The panel 30 may further include a magnet 302. The magnet 302 may be attached to the rear surface of the plate 31. When the panel 30 is mounted on the door body 40, the magnet 302 may be attached to the body plate 41 by magnetic force.

Thus, the panel 30 may be temporarily fixed to the door body 40 by the magnet 302. In addition, the panel 30 may be maintained in a state of being more firmly mounted to the door body 40 by the magnet 302.

The magnet 302 may be disposed to be elongated vertically and may be disposed between the upper bracket 32 and the lower bracket 33. In addition, the magnet 302 may be disposed on each of both left and right sides of the buffer member 34.

Hereinafter, the structure of each of the upper bracket, the upper cap decoration, and the decoration cover will be described in more detail with reference to the drawings.

Figure 7:
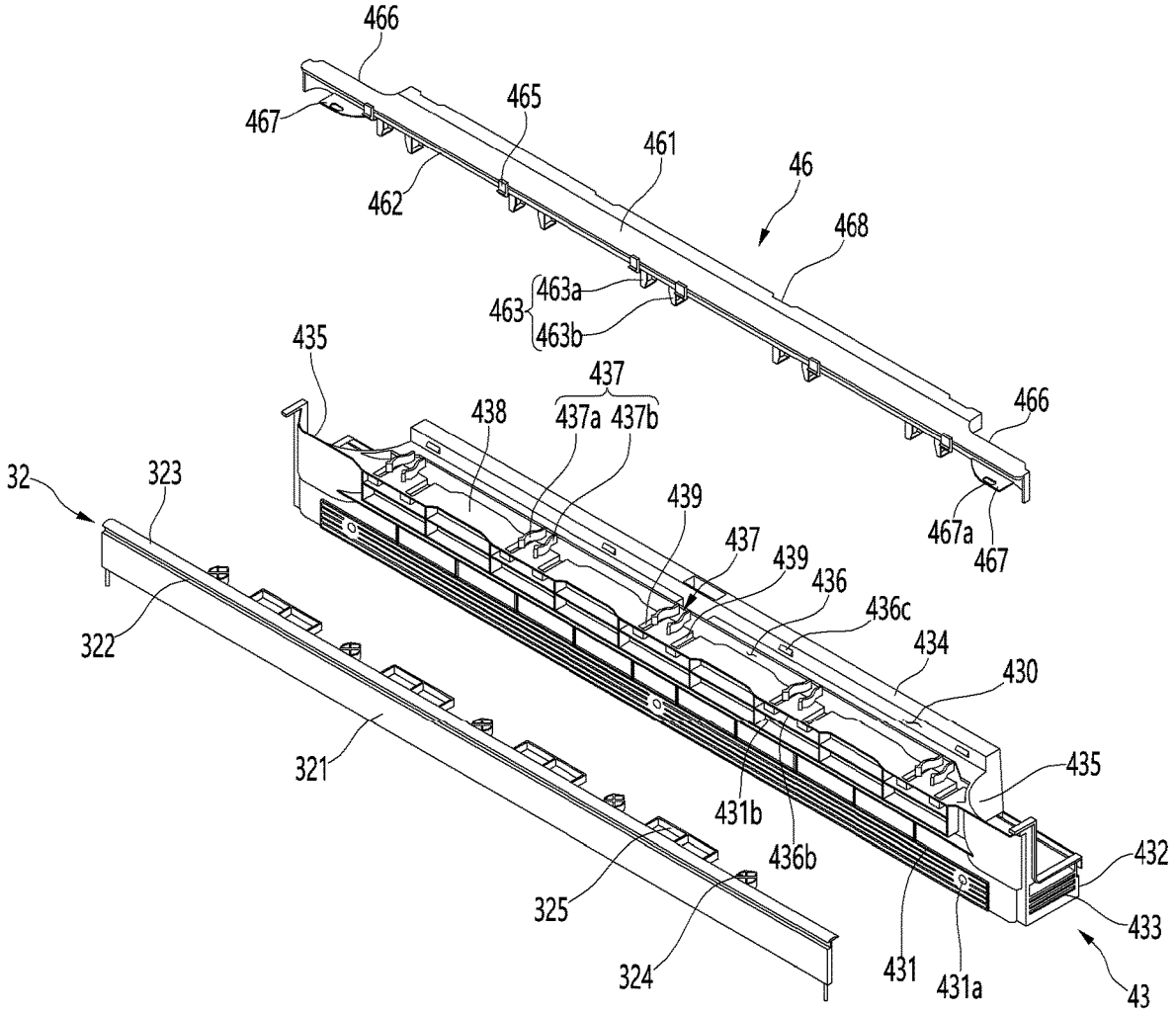
FIG. 7 is an exploded perspective view illustrating a coupling structure of an upper bracket, an upper cap decoration, and a decoration cover according to an embodiment.
Figure 8:
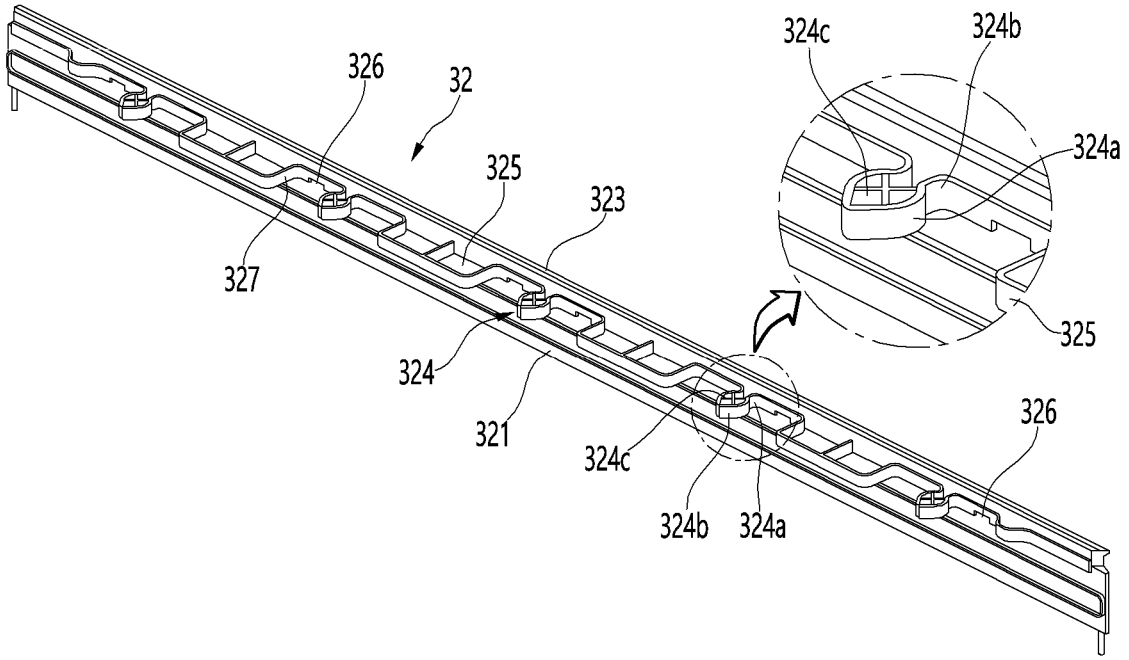
FIG. 8 is a rear perspective view of the upper bracket.

FIG. 7 is an exploded perspective view illustrating a coupling structure of the upper bracket, the upper cap decoration, and the decoration cover according to an embodiment. Also, FIG. 8 is a rear perspective view of the upper bracket.

As illustrated in the drawings, the upper bracket 32 may be disposed in front of the upper cap decoration 43 and may be mounted on the upper cap decoration 43 when the panel 30 is mounted.

The upper bracket 32 may be made of a plastic material. The upper bracket 32 may include a coupling portion 321 coupled to the rear surface of the plate 31 and a mounting protrusion 324 protruding backward from a rear surface of the coupling portion 321.

The upper bracket 32 may further include a mounting guide 325 protruding backward from the rear surface of the coupling portion 321. The upper bracket 32 may further include a support portion 323 extending forward from an upper end of the coupling portion 321.

In detail, the coupling portion 321 may be a portion attached to the rear surface of the plate 31 and may be provided in a plate shape having a predetermined area. A horizontal width of the coupling portion 321 may correspond to a horizontal length of the plate 31.

An adhesive may be applied to the front surface of the coupling portion 321, or a member for adhesion such as a double-sided tape may be disposed. Thus, the coupling portion 321 may maintain a state for the complete adhesion to the rear surface of the plate 31.

The upper accommodation groove 322 may be defined in an upper portion of the coupling portion 321. The upper accommodation groove 322 may define a space in which the bent upper end of the plate 31 is accommodated when the plate 31 is provided in the metal plate shape.

The support portion 323 may be disposed on the upper end of the upper bracket 32. The support portion 323 may be disposed above the coupling portion 321 to protrude forward.

The support portion 323 may protrude up to a position corresponding to the front surface of the plate 31, and thus, the support portion 323 may define the outer appearance of the upper end of the panel 30 while supporting the upper end of the plate 31. The support portion 323 may support the upper end of the plate 31 to restrict the upward movement of the plate 31 and simultaneously may protect the upper end of the plate 31 from being damaged by an impact.

The support portion 323 may also protrude backward, and the rear end of the support portion 323 may be in contact with a front end of the decoration cover 46. In addition, the support portion 323 may define the outer appearance of the top surface of the panel 30, furthermore, an outer appearance of a front end of the top surface of the door 20.

The mounting protrusion 324 may protrude backward from a rear surface of the coupling portion 321. The mounting protrusion 324 may protrude from a position facing the protrusion accommodation portion 437 of the upper cap decoration 43. A plurality of mounting protrusions 324 may be disposed at regular intervals along the upper bracket 32 so that the upper end of the panel 30 is stably fixed to the door body 40.

In detail, the mounting protrusion 324 may include an extension portion 324*b* and an insertion portion 324*a*. The extension portion 324*b* may protrude backward from the coupling portion 321 and may have a length and width that are enough to be inserted into an accommodation portion opening 437*d* defined in the front end of the protrusion accommodation portion 437.

The insertion portion 324*a* may be disposed on a rear end of the extension portion 324*b* and may be provided in a shape that is insertable into the protrusion accommodation portion 437.

The insertion portion 324*a* may have a width greater than that of the extension portion 324*b* and may have a shape to be in contact with an inner surface of the protrusion accommodation portion 437 in a state of being inserted into the protrusion accommodation portion 437. The insertion portion 324*a* may be easily inserted into the protrusion accommodation portion 437 and may maintain the restricted state in the inserted state so as not to be easily separated.

For example, the insertion portion 324*a* may be provided so that a central portion thereof has the largest width to become narrower toward the front and rear sides. A circumferential surface of the insertion portion 324*a* may be inclined or rounded.

The insertion portion 324*a* may be provided to become narrower toward the front side so that the insertion into the protrusion accommodation portion 437 and elastic deformation of the protrusion accommodation portion 437 are facilitated.

The extension portion 324*b* may have a width less than that of a middle portion of the insertion portion 324*a*. Thus, when the mounting protrusion 324 is inserted into the protrusion accommodation portion 437, the extension portion 324*b* may be provided so that a front end of the protrusion accommodation portion 437 is accommodated. Thus, an outer surface of the extension portion 324*b* may be provided in a shape corresponding to an inner surface of the front end of the protrusion accommodation portion 437.

The mounting protrusion 324 may have a predetermined height in the vertical direction, and both the insertion portion 324*a* and the extension portion 324*b* may have circumferential surfaces having the same height. A top surface of the mounting protrusion 324 may be opened to define a protrusion space 234*c* therein.

Due to the protrusion space 324*c*, when the upper bracket 32 is injection-molded, the upper bracket 32 may be reduced in weight, and the mounting protrusion 324 may be accurately molded into a set size and shape without contraction. Thus, the coupling between the mounting protrusion 324 and the protrusion accommodation portion 437 may be secured.

A rib for maintaining the shape of the protrusion space 324*c* may be disposed to cross the inside of the protrusion space 324*c*.

A mounting guide 325 may protrude between the plurality of mounting protrusions 324. The mounting guide 325 may guide the mounting protrusion 324 to be easily inserted into the protrusion accommodation portion 437 when the panel 30 is mounted on the door body 40.

The mounting guide 325 may be disposed between the plurality of mounting protrusions 324 to guide the entirety of the plurality of mounting protrusions 324 to be simultaneously inserted into the protrusion accommodation portion 437.

The mounting guide 325 may protrude backward at the same height as the mounting protrusion 324. The mounting guide 325 may protrude the same as or slightly shorter than the mounting protrusion 324.

A bottom surface of the mounting guide 325 may be provided in a flat shape and may be seated on a seating portion 438 to be described below. Here, a height of the bottom surface of the mounting guide 325 may be the same as that of the bottom surface of the mounting protrusion 324. Therefore, when the mounting guide 325 is inserted in a state of being disposed on the seating portion 438 disposed on the upper cap decoration 43, the mounting protrusion 324 may also be inserted into the protrusion accommodation portion 437.

The mounting guide 325 may have a predetermined area and may have an area greater than that of the mounting protrusion 324. The mounting guide 325 may be disposed in a space other than a space, in which the mounting protrusion 324, the protrusion accommodation portion 437, and the restriction portion 463 are disposed, and may be seated on the seating portion 438 to support the panel 30. Therefore, it may be easy to assemble and mount the panel 30 having a heavy weight, and it is possible to stably maintain the mounted state.

A circumference of the mounting guide 325 may be continuously connected to a circumference of the mounting protrusion 324. That is, an edge portion 327 on which the mounting guide 325 and the mounting protrusion 324 are continuously disposed may be disposed on the upper bracket 32. Thus, the mounting protrusion 324 and the mounting guide 325 may be integrally molded during the molding of the upper bracket 32 or may be injection-molded with a plastic material.

A cover hook portion 326 may be disposed at each of both left and right sides of the mounting protrusion 324. The cover hook portion 326 may be disposed at a position corresponding to a coupling portion of the decoration cover 46 to be described below. The cover hook portion 326 may be disposed so that the coupling portion 465 is hooked.

The cover hook portion 326 may be disposed on the edge portion 327. The cover hook portion 326 may be recessed at an end of the edge portion 327 so that the coupling portion 465 is locked when the decoration cover 46 is mounted on the upper cap decoration 43. Thus, the decoration cover 46 may be double-fixed to the upper cap decoration 43 and the upper bracket 32.

Figure 9:
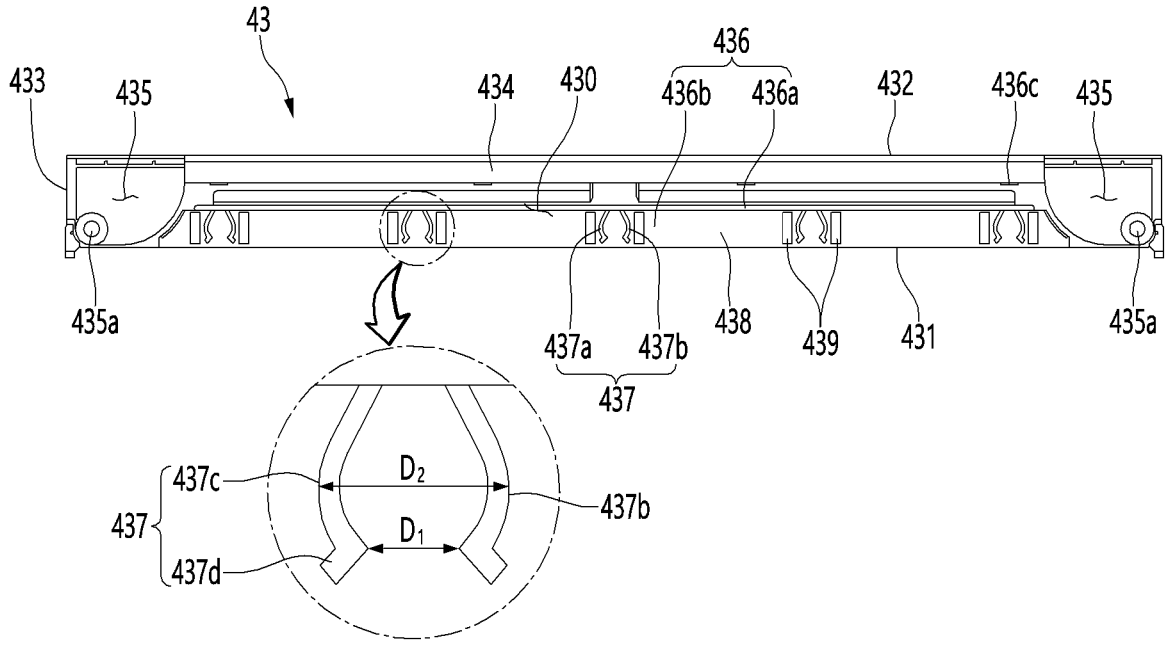
FIG. 9 is a plan view of the upper cap decoration.

FIG. 9 is a plan view of the upper cap decoration.

When the upper cap decoration 43 is mounted on the door body 40, rear, front, and top surfaces of the upper cap decoration 43 may be exposed to the outside.

In detail, the upper cap decoration 43 may include a front surface portion 431 defining a front surface thereof, a rear surface portion 432 defining a rear surface thereof and coupled to the door liner 42, a top surface portion 433 defining a top surface thereof, and a side surface 434 defining each of both left and right surfaces thereof.

The front surface portion 431 may be coupled to an upper end of the body plate 41. The front surface portion 431 may be exposed forward in the state of being mounted on the door body 40 and may define an outer appearance of an upper end of the front surface of the door body 40.

A cover coupling portion 431*a* may be disposed on a lower end of the front surface portion 431. A decoration screw hole may be defined in the cover coupling portion 431*a*, and a screw passing through the body plate 41 may be coupled thereto.

A decoration recessed portion 436 may be provided in an upper end of the front surface portion 431. The decoration recessed portion 436 may define a space in which the mounting protrusion 324, the mounting guide 325, and the restriction portion 463 are disposed, and the protrusion accommodation portion 437, the seating portion 438 and A restriction accommodation grove 439 may be defined.

The decoration recessed portion 436 may be provided in an edge area of each of the front and top surfaces of the upper cap decoration 43 and may be disposed along a horizontal extension direction of the upper cap decoration 43. The decoration recessed portion 436 may have opened front and top surfaces and be recessed backward and downward. Therefore, when the panel 30 is mounted, the mounting protrusion 324 and the mounting guide 325 are inserted from a front side, and when the decoration cover 46 is mounted, the restriction portion 463 may be inserted from an upper side.

The decoration recessed portion 436 may include a recessed portion bottom surface 436*b* and a recessed portion rear surface 436*a*. The recessed portion bottom surface 436*b* may define a downwardly recessed bottom surface of the decoration recessed portion 436, and the recessed portion rear surface 436*a* may define a rear wall surface that is recessed backward.

Here, a front end of the recessed portion bottom surface 436*b* may extend up to a front end of the front surface portion 431 and may be in contact with a rear surface of the coupling portion 321 of the upper bracket 32 when the panel 30 is mounted. Therefore, the upper bracket 32 may be supported at the rear side in the state in which the panel 30 is mounted, and the panel 30 may be prevented from being deformed even if force is applied to an upper end of the front surface of the panel 30, or the upper end of the front surface of the panel 30 is pressed.

The recessed portion bottom surface 436*b* may be disposed below the top surface of the upper cap decoration 43. A bottom surface of the decoration opening 430 shielded by the decoration cover 46 may be defined.

A seating portion 438 may be disposed on the recessed portion bottom surface 436*b*. The seating portion 438 may be disposed at a position corresponding to the mounting guide 325 and may be provided so that the bottom surface of the mounting guide 325 is seated.

The seating portion 438 may be disposed between the plurality of protrusion accommodation portions 437 to protrudes upward so that, when the mounting guide 325 is seated, the mounting protrusion 324 is disposed at a height at which the mounting protrusion 324 is inserted into the protrusion accommodation portion 437.

In addition, a restriction portion accommodation groove 439 may be defined in the recessed portion bottom surface 436*b*. The restriction portion accommodation groove 439 may be a groove in which a lower end of the restriction portion 463 is accommodated when the decoration cover 46 is mounted and may be provided to maintain the state in which the restriction portion 463 is firmly fixed.

The restriction portion accommodation groove 439 may be defined in each of both left and right sides of the protrusion accommodation portion 437 and may be disposed below each of both surfaces of the protrusion accommodation portion 437. Therefore, in the state in which the lower end of the restriction portion 463 is inserted into the restriction portion accommodation groove 439, it may be ensured that the restriction portion 463 restricts both the surfaces of the protrusion accommodation portion 437.

The protrusion accommodation portion 437 may be defined inside the decoration recessed portion 436. The protrusion accommodation portion 437 may be disposed at a position facing the mounting protrusion 324 and may be provided in a number corresponding to that of mounting protrusions 324 and coupled to each of the mounting protrusions 324.

The protrusion accommodation portion 437 may be constituted by a pair of accommodation members 437*a* and 437*b*, which are defined in the decoration recessed portion 436 and spaced apart from each other. The protrusion accommodation portion 437 may be provided in a plate shape having a predetermined thickness, and the mounting protrusion 324 may be inserted between the pair of accommodation members 437*a* and 437*b*.

In detail, the accommodation members 437*a* and 437*b* may protrude forward from the recessed portion rear surface 436*a*. A lower end of each of the accommodation members 437*a* and 437*b* may be spaced apart from the recessed portion bottom surface 436*b*. Thus, the accommodation members 437*a* and 437*b* extending forward may be elastically deformed in the left and right directions according to the insertion of the mounting protrusion 324.

The pair of accommodation members 437*a* and 437*b* may be spaced apart from each other at both left and right sides and may be provided to be symmetrical to each other. The extending front ends of the pair of accommodation members 437*a* and 437*b* may be spaced apart from each other to define an accommodation portion opening into which the mounting protrusion 324 is inserted.

The accommodation members 437*a* and 437*b* may include an inlet portion 437*d* and a fixing portion 437*c*. The inlet portion 437*d* may define front ends of the accommodation members 437*a* and 437*b*, and may define an opening of the accommodation portion, i.e., a portion into which the mounting protrusion 324 is inserted.

The inlet portion 437*d* may be disposed to face outward as it protrudes forward. Thus, a distance between the inlet portions 437*d* of the accommodation members 437*a* and 437*b* at both sides may increase toward the front side so that the mounting protrusion 324 is easily inserted.

The fixing portion 437*c* may extend from a rear end of the inlet portion 437*d* to the recessed portion rear surface 436*a*. The fixing portion 437*c* may be provided to be the widest and to have a gap that is narrower toward the front and rear sides.

The fixing portion 437*c* may be provided in a shape corresponding to a shape of an outer surface of the insertion portion 324*a* to cover the outer surface of the insertion portion 324*a* of the mounting protrusion 324. That is, the accommodation members 437*a* and 437*b* may be provided in a round shape corresponding to the outer surface of the insertion portion 324*a*. A front end of the fixing portion 437*c*, i.e., a gap D1 between the inlet portions 437*d* may be less than a gap between the widest portions of the mounting protrusions 324.

Thus, when the panel 30 is mounted, the mounting protrusion 324 may be press-fitted between the pair of accommodation members 437*a* and 437*b*. In the process of inserting the mounting protrusion 324, the accommodation members 437*a* and 437*b* may be elastically deformed. After the mounting protrusion 324 is inserted, the accommodation members 437*a* and 437*b* may cover an outer surface of the insertion portion 324*a* so that the mounting protrusion 324 is restricted so as not to be easily separated from the inside the protrusion accommodation portion 437.

A distance D2 between the outer surfaces of the fixing portions 437*c* of the accommodation members 437*a* and 437*b* disposed at both the sides may correspond to a distance D4 between the restriction portions 563. Thus, when the decoration cover 46 is mounted, the restriction portion 463 may be in contact with the outer surfaces of the accommodation members 437*a* and 437*b* disposed on both the sides to prevent the protrusion accommodation portion 437 from being deformed.

The top surface portion 433 of the upper cap decoration 43 may connect the rear surface portion 431 to an upper end of the front surface portion 431 and may define the top surface of the door body 40. A decoration opening 430 recessed downward may be defined in the top surface portion 433.

The decoration opening 430 may define a space having an opened top surface, and the decoration depression 436 may be defined in an inner area of the decoration opening 430. In addition, electrical components such as a sensor and a PCB may be disposed in the door 20 inside the decoration opening 430.

The decoration opening 430 may be shielded by the decoration cover 46. The decoration cover 46 may be provided in a corresponding shape to shield the decoration opening 430. Thus, when the decoration cover 46 is mounted, the opened top surface of the decoration depression 436 may also be shielded.

A restriction protrusion 436*c* may be disposed on a rear end of the decoration opening 430 so that the decoration cover 46 is hooked to be restricted when the decoration cover is mounted. The restriction protrusion 436*c* may protrude forward and may be inserted into the protrusion groove 468 defined in the rear end of the decoration opening 430.

The decoration cover 46 may be detachably mounted in the decoration opening 430, and when the decoration cover 46 is attached, the upper bracket 32 may be additionally fixed to remain in the state of being coupled to the upper cap decoration 43, and when the decoration cover 46 is separated, the upper bracket 32 and the upper cap decoration 43 may be separated from each other.

A hinge mounting portion 435 recessed downward may be disposed at one side of the top surface portion 433. The hinge mounting portion 435 may be a portion, to which a hinge device serving as a rotation shaft of the door 20 is mounted, and may be disposed at one side of both left and right sides. A hinge hole 435*a* may be defined in the hinge mounting portion 435.

Figure 10:
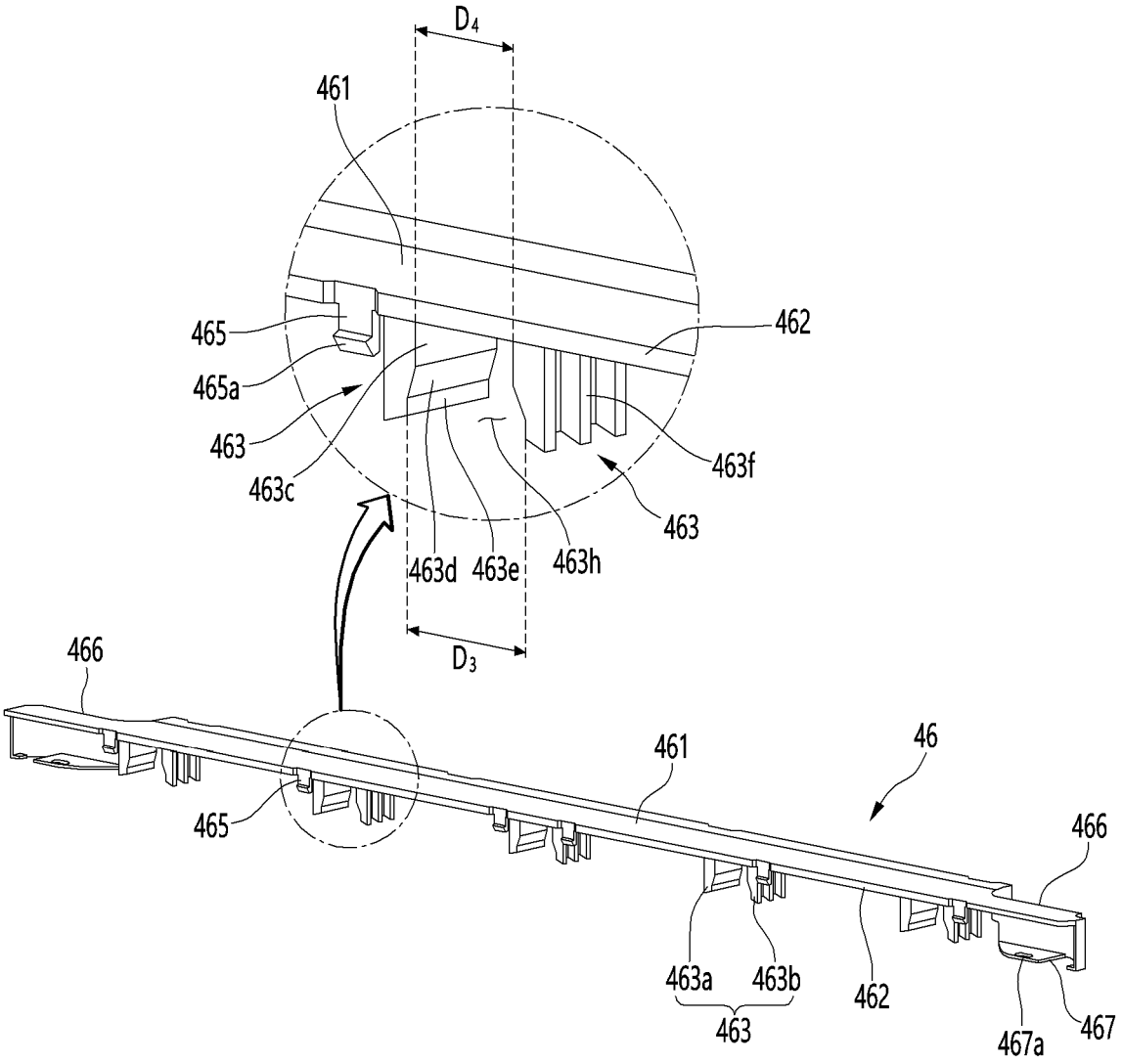
FIG. 10 is a perspective view of the decoration cover.

FIG. 10 is a perspective view of the decoration cover.

As illustrated in the drawing, the decoration cover 46 may be mounted on the upper cap decoration 43 to shield the decoration opening 346 and define at least a portion of the outer appearance of the top surface of the door body 40.

In the state in which the decoration cover 46 is mounted, the top surface of the door body 40 may be defined by the top surface portion 433 of the upper cap decoration 43, the cover top surface 461 of the decoration cover 46, and the support portion 323 of the upper bracket 32.

The decoration cover 46 may include a cover top surface 461 that shields the decoration opening 346 and a cover edge 462 extending downward along a circumference of the cover top surface 461.

A coupling portion 465 may be disposed on a front end of the cover edge 462. The coupling portion 465 may be disposed at a position corresponding to the cover hook portion 326 of the upper bracket 32. Therefore, when the decoration cover 46 is mounted, the coupling portion 465 may be coupled to the cover hook portion 326, and the decoration cover 46 may be fixed to the upper bracket 32. For example, a lower end 465*a* of the coupling portion 465 may protrude in a hook shape.

The protrusion groove 468 may be defined in a rear end of the cover edge 462, and the protrusion groove 468 may be coupled to the restriction protrusion 436*c* disposed on the upper cap decoration 43. Thus, when the decoration cover 46 is mounted, the upper cap decoration 43 may be further fixed to the upper cap decoration 43.

The restriction portion 463 that restricts the protrusion accommodation portion 437 may be disposed on the bottom surface of the decoration cover 46. The restriction portion 463 may be disposed vertically above the plurality of protrusion accommodation portions 437. The restriction portion 463 may be provided in a number corresponding to the plurality of protrusion accommodation portions 437. Thus, when the decoration cover 46 is mounted, each of the restriction portions 463 may be coupled to the corresponding protrusion accommodation portion 437 to restrict the protrusion accommodation portion 437.

In detail, the restriction portion 463 may be constituted by a pair of restriction members 463*a* and 463*b* spaced apart from each other. The restriction members 463*a* and 463*b* may extend downward from the cover top surface 461. That is, the restriction members 463*a* and 463*b* may extend in a direction crossing the accommodation members 437*a* and 437*b*. The pair of restriction members 463*a* and 463*b* may extend to be in contact with outer surfaces of the pair of accommodation members 437*a* and 437*b*.

Here, an extending length of each of the restriction members 463*a* and 463*b* may be provided as a length at which the restriction members 463*a* and 463*b* cross at least a portion of the accommodation members 437*a* and 437*b* when the decoration cover 46 is mounted.

When the decoration cover 46 is mounted, the accommodation members 437*a* and 437*b* and the mounting protrusion 324 may be disposed between the pair of restriction members 463*a* and 463*b*.

The mounting protrusion 324 may maintain a state of being inserted into the accommodation members 437*a* and 437*b*.

Each of the restriction members 463*a* and 463*b* may have a length that is enough to be inserted into the restriction portion accommodation groove 439 through each of the accommodation members 437*a* and 437*b* in the state in which the decoration cover 46 is mounted.

The pair of restriction members 463*a* and 463*b* may be disposed to face each other and may be disposed to be symmetrical to each other based on the space between the restriction members 463*a* and 463*b*.

The restriction members 463*a* and 463*b* may include inner surfaces facing each other and outer surfaces facing opposite surfaces.

The restriction portion 463, i.e., the inner surfaces of the restriction members 463*a* and 463*b* may be disposed in an order of a restriction portion upper portion 463*c*, an inclined surface 463*d*, and a restriction portion lower portion 463*e* from the upper side to the lower side.

The restriction portion upper portion 463*c* and the restriction portion lower portion 463*e* may be vertically disposed, respectively, and may define upper and lower ends of the restriction portion 463, respectively. The restriction portion upper portion 463*c* and the restriction portion lower portion 463*e* may extend downward to perpendicular to the top surface 461 of the cover.

The restriction portion upper portion 463*c* and the restriction portion lower portion 463*e* may be disposed to be stepped with respect to each other. That is, in the restriction members 463*a* and 463*b* disposed at both the sides, a distance D4 between the restriction portion upper portions 463*c* may be greater than a distance D3 between the restriction portion lower portions 463*e*.

Here, the distance D3 between the restriction portion lower portions 463*e* may be greater than a width D2 between the outer surfaces of the protrusion accommodation portion 437, and thus, when the decoration cover 46 is mounted, the restriction portion 463 may pass through the protrusion accommodation portion 437 and then be directed downward.

The distance D4 between the restriction portion upper portions 463*c* may correspond to the width D2 between the outer surfaces of the protrusion accommodation portion 437. Thus, in the state in which the decoration cover 46 is mounted, the outer surface of the protrusion accommodation portion 437 may be restricted at both sides by the restriction portion 463.

The inclined surface 463*d* may be disposed on an inner surface of each of the restriction members 463*a* and 463*b*. The inclined surface 463*d* may be disposed to be connected between the restriction portion upper portion 463*c* and the restriction portion lower portion 463*e*. Therefore, when the decoration cover 46 is mounted on the upper cap decoration 43, the decoration cover 46 may be in contact with the protrusion accommodation portion 437 inserted between the restriction portions 463, and the outer surface of the protrusion accommodation portion 437 may be guided toward the restriction portion upper portion 463*c*.

The inclined surface 463*d* may be maintained in the state in which the inner surface of the restriction portion 463 presses through the outer surface of the protrusion accommodation portion 437 so that the protrusion accommodation portion 437 and the mounting protrusion 324 are firmly fixed to each other.

A reinforcing rib 463*f* may be disposed on an outer surface of the restriction portion 463, i.e., each of the restriction members 463*a* and 463*b*. The reinforcing rib 463*f* may extend in the vertical direction and may extend from an upper end to a lower end of the outer surface of each of the restriction members 463*a* and 463*b*.

The plurality of reinforcing ribs 463*f* may be disposed at regular intervals in the front and rear direction and may support the restriction portion 463 to prevent the restriction portion 463 from being deformed or damaged even when a load is applied to the restriction portion 463.

A cover part 466 may be disposed at each of both left and right ends of the decoration cover 46. The cover portion 466 may be disposed at a position corresponding to the hinge mounting portion 435 and be recessed when viewed from the upper and rear sides so as not to interfere with the hinge device 203 mounted on the hinge mounting portion 435.

The cover portion 466 may cover at least a portion of the hinge mounting portion 435 and may define a portion of the hinge mounting portion 435 in the state in which the decoration cover 46 is mounted.

A cover coupling portion 467 may be disposed on a lower end of the cover portion 466. The cover coupling portion 467 may extend forward from each lower ends of both the lower left and right sides of the decoration cover 46 and may be supported by the upper cap decoration 43. For example, the cover coupling portion 467 may be supported on a bottom surface of the hinge mounting portion 435. In addition, a hole 467*a* into which a screw 468 is coupled may be defined in the cover coupling portion 467 so that the decoration cover 46 is more firmly fixed to the upper cap decoration 43.

That is, in the state in which the decoration cover 46 is mounted on the upper cap decoration 43, the restriction portion 463 may restrict the protrusion accommodation portion 437 so that the mounting protrusion 324 and the protrusion accommodation portion 437 are not separated from each other, and since the cover coupling portion 467 is firmly fixed to the upper cap decoration 43, it is possible to additionally prevent the mounting protrusion 324 from being separated from the protrusion accommodation portion 437.

Figure 11:
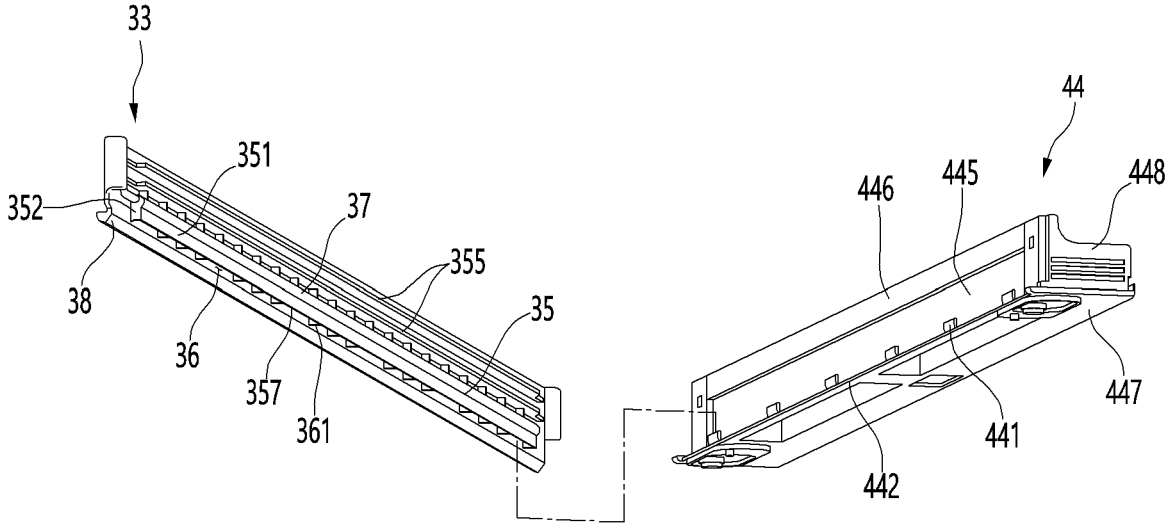
FIG. 11 is a view illustrating a coupling structure of a lower bracket and a lower cap decoration, which are components of the door.
Figure 12:
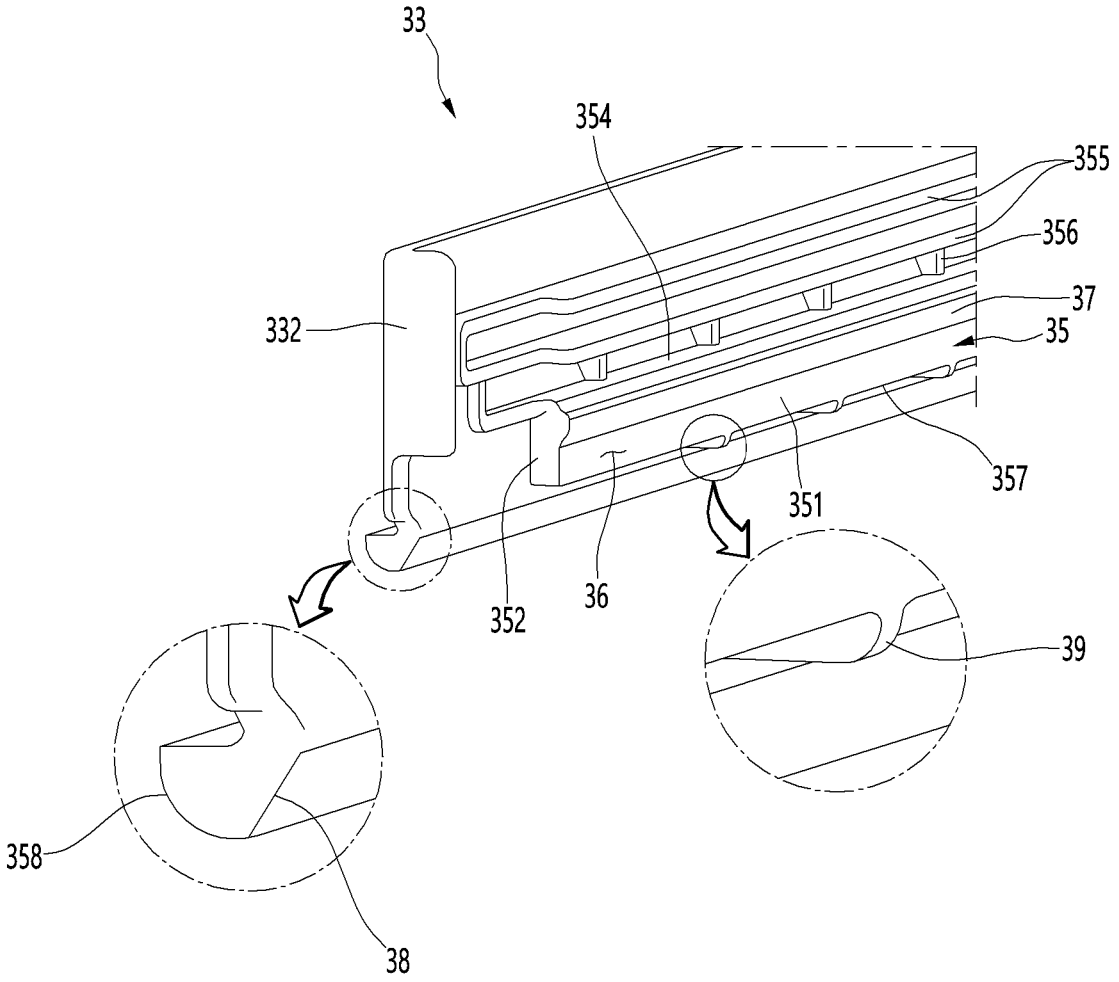
FIG. 12 is an enlarged view illustrating a portion of the lower bracket.
Figure 13:
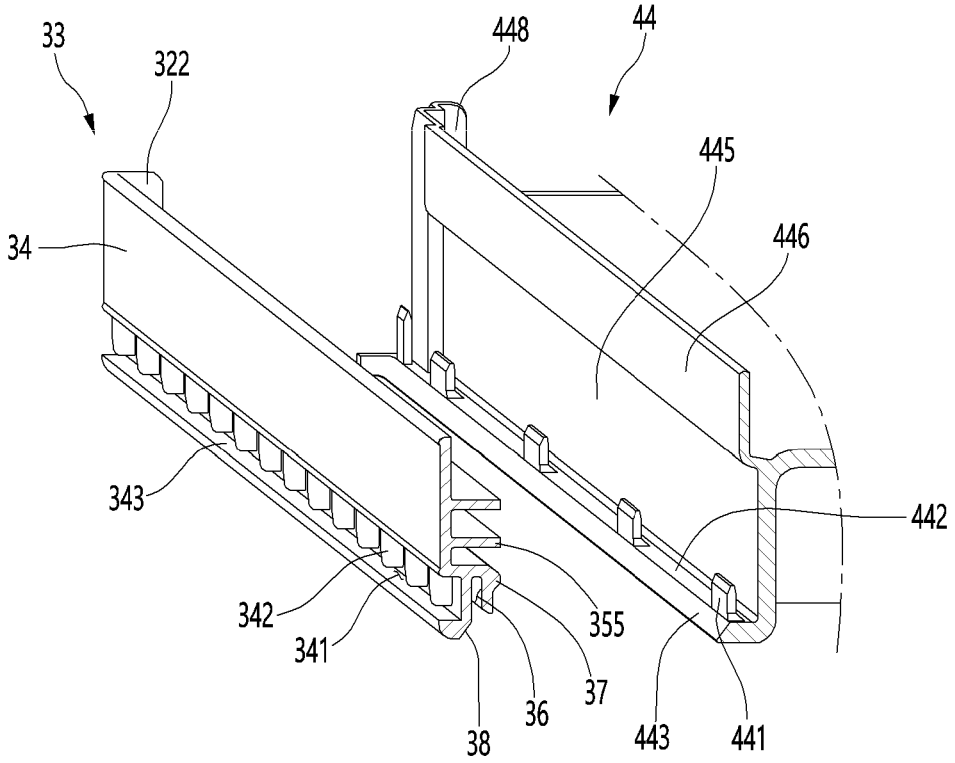
FIG. 13 is a view illustrating one cross-section of the lower bracket and the lower cap decoration.
Figure 14:
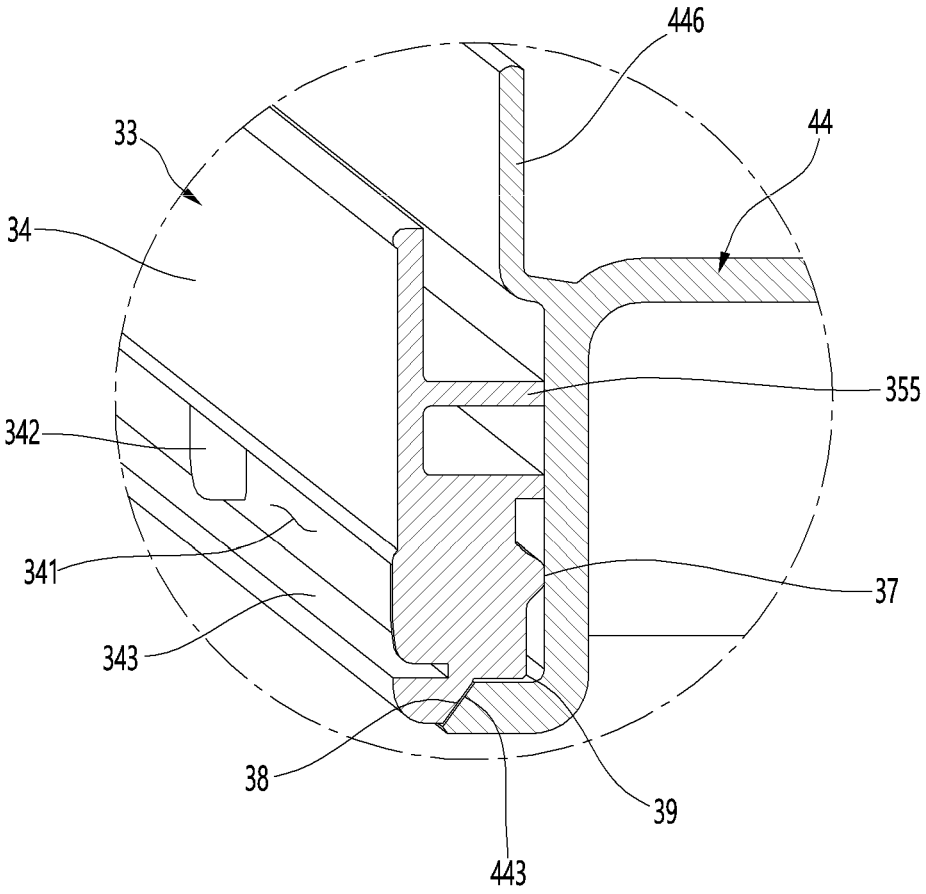
FIG. 14 is a cross-sectional view illustrating a state in which a buffer rib of the lower bracket is in contact with the lower cap decoration.
Figure 15:
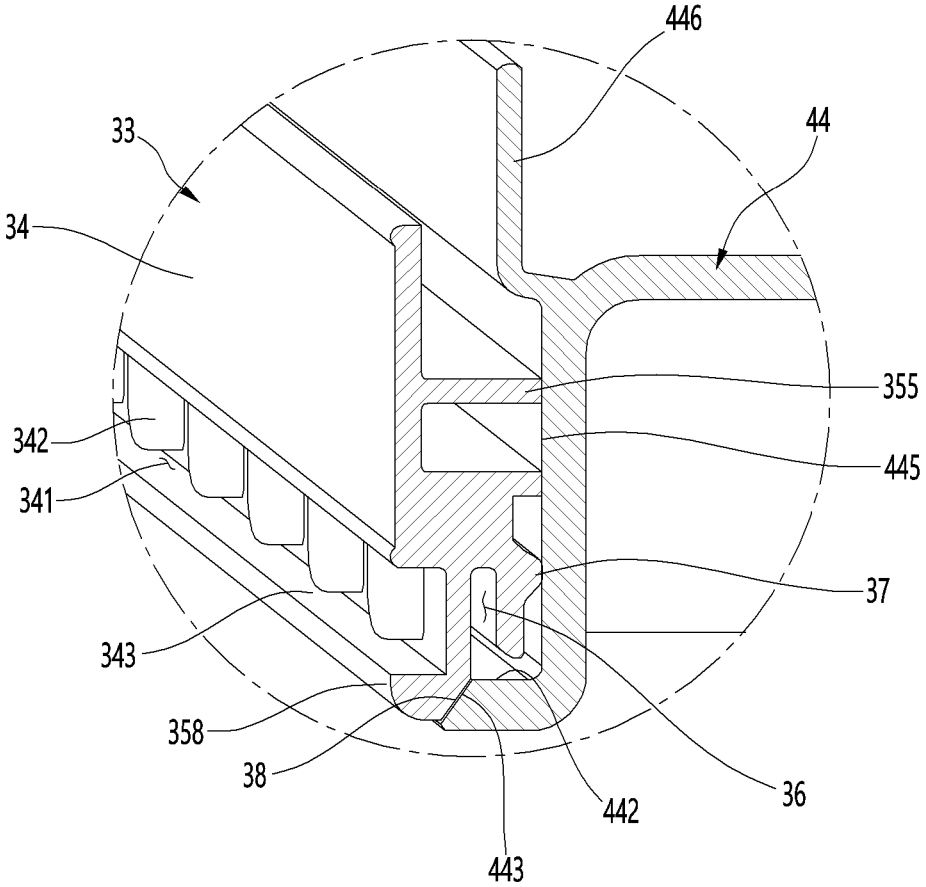
FIG. 15 is a view illustrating one cross-section in the state in which the lower bracket and the lower cap decoration are coupled to each other.

FIG. 11 is a view illustrating a coupling structure of the lower bracket and the lower cap decoration, which are components of the door. Also, FIG. 12 is an enlarged view illustrating a portion of the lower bracket. Also, FIG. 13 is a view illustrating one cross-section of the lower bracket and the lower cap decoration. Also, FIG. 14 is a cross-sectional view illustrating a state in which a buffer rib of the lower bracket is in contact with the lower cap decoration. Also, FIG. 15 is a view illustrating one cross-section in the state in which the lower bracket and the lower cap decoration are coupled to each other.

The lower bracket 33 may include a body portion 351 spaced apart from one surface of the lower bracket 33 to extend along the extension direction of the lower bracket 33, a connection portion 352 extending from both ends of the body portion 351 toward the lower bracket 33, and an opening 357 and may further include a mounting portion 35 having a space into which the restriction portion is inserted.

The mounting portion 35 may extend along the left and right direction in which the body portion 351 extends and may include a hook protrusion 37 protruding in the direction of the cap decoration 44. The hook protrusion 37 may be in contact with a front surface of the cap decoration 44 in a state in which the panel bracket is mounted on the cap decoration 44.

The mounting portion 35 may include a buffer rib 39 disposed to protrude further in one direction than the opening 357.

The buffer rib 39 protruding downward from a lower end of the body portion 351 may be provided.

The buffer rib 39 may be disposed on each of both sides of the restriction portion 441 in the state in which the restriction portion 441 is inserted into the mounting portion 35.

The cap decoration 44 may be bent to extend from one surface and may include a seating portion 442 on which the plurality of restriction portions 441 are disposed. The buffer rib 39 may be in contact with the seating portion 442 in the state in which the panel bracket is mounted on the cap decoration.

In a state in which the restriction portion 441 is inserted into the mounting portion 35, the body portion 351 may be maintained in the state of being spaced apart from the seating portion 442.

In the space in which the restriction portion 441 is inserted, the restriction portion 441 may extend from the lower bracket 33 to the body portion 351. In the state in which the restriction portion 441 is inserted into the mounting portion 35, a partition portion may be disposed on each of both sides of the restriction portion 441.

The lower bracket 33 may further include a bracket rib 355 that is spaced apart from the mounting portion 35 and extends to be elongated along the left and right direction in which the body portion 351 extends.

The lower bracket 33 may include an inclined portion 38 that is inclined toward the door panel 30 from one end of a surface on which the mounting portion 35 is disposed.

The cap decoration 44 may include a decoration inclined portion 443 disposed to match the inclined portion 38 at a position corresponding to the inclined portion 38.

The lower bracket may include an inclined portion 38 that is inclined to approach the door panel 30 downward at a lower end of the rear surface thereof, and the cap decoration 44 may include a decoration inclined portion 443 disposed to be closer to the door panel 30 downward from a front end of the seating portion 442 on which the restriction portion 441 is disposed.

The lower bracket 33 may include a coupling portion 34 coupled to the door panel 30 on the other surface facing the mounting portion 35, and an accommodation groove 341 that is recessed backward may be defined in one end of the coupling portion 34. A plurality of ribs may be arranged in the accommodation groove 341 in the left and right direction in which the lower bracket 33 extends.

The door panel 30 may be bent backward from one end to provide a bending portion, and the bending portion may be inserted and fixed between the accommodation groove 341 and the rib.

The cap decoration 44 may include a decoration coupling portion 445, to which the lower bracket 33 is mounted, and an extension portion 446 extending from one end of the decoration coupling portion 445 and coupled to the door body, and the decoration coupling portion 445 may be further recessed than the extension portion 446 in one direction.

The lower bracket 33 may be provided at a lower end of the door panel 30. The lower bracket 33 may be attached to the lower end of the rear surface of the door panel 30.

The lower bracket 33 may also be referred to as a panel bracket.

The lower bracket 33 may have a length corresponding to a length of the door panel 30 in the horizontal direction. The lower end of the lower bracket 33 may protrude downward more than the lower end of the door panel 30.

A coupling portion 34 coupled to the rear surface of the door panel 30 may be disposed on the front surface of the lower bracket 33. A mounting portion 35 protruding backward to be mounted on the lower cap decoration 44 may be disposed on the rear surface of the lower bracket 33.

Since the coupling portion 34 and the mounting portion 35 are provided on the lower bracket 33, the coupling portion 34 and the mounting portion 35 may also be referred to as the lower coupling portion 34 and the lower bracket 33, respectively.

The lower coupling portion 34 may be provided in a plate shape to provide an area to be bonded to the rear surface of the door panel 30 with an adhesive. The adhesive or the like may be applied to the front surface of the lower coupling portion 34 so that the lower coupling portion 34 is mounted on the front panel 31.

The lower accommodation groove 341 that is recessed backward may be defined in a lower end of the lower coupling portion 34. The lower accommodation grove 341 may be recessed by a predetermined depth backward from the front surface of the lower bracket 33.

A plurality of ribs 342 may be arranged in the lower accommodation grove 341 in a direction in which the lower bracket 33 extends in the horizontal direction. Each of the ribs 342 may also be referred to as a lower rib 342.

A support portion 343 protruding forward to seat the being portion of the door panel 30 thereon may be disposed on the lower end of the lower accommodation grove 341. The support portion 343 may also be referred to as a lower support portion 343.

A top surface of the lower support portion 343 may be provided as a flat surface so that the bending portion disposed on the lower end of the door panel 30 is seated. Also, the front surface of the lower support portion 343 may be provided in a rounded shape.

Due to this structure, the lower bracket 33 may be more firmly mounted on the lower end of the door panel 30.

In detail, the bending portion that is bent backward may be disposed on the lower end of the door panel 30, and the bending portion may be inserted between the lower rib 341 and the lower support portion 343 so as to be seated on the lower support portion 343.

Here, the lower rib 341 may be disposed to be in contact with a portion of the rear surface of the door panel 30. Thus, the lower end of the door panel 30 may be prevented from being deformed by the lower rib 341.

The rear surface of the lower bracket 33 may have a structure capable of being coupled to the lower cap decoration 44.

A lower mounting portion 35 having a space 36 in which the restriction portion 441 of the lower cap decoration 44 is inserted through an opened one surface thereof may be defined in the rear surface of the lower bracket 33. The lower mounting portion 35 may be disposed at a position corresponding to the lower accommodation grove 341.

The plurality of restriction portions 441 restricted upward may be arranged on the lower end of the front surface of the lower cap decoration 44 in the direction in which the lower cap decoration 44 extends. In the state in which the lower bracket 33 is mounted on the door panel 30, the restriction portion 441 may be inserted into the opening 357 of the lower mounting portion 35 to couple the lower bracket 33 to the lower cap decoration 44.

In detail, the lower mounting portion 35 includes a body portion 351 spaced backward from the rear surface of the lower bracket 33 and a connection portion 352 connecting the body portion 351 to the rear surface of the lower bracket 33.

A bottom surface of the lower mounting portion 35 includes an opening 357 opened so that the restriction portion 441 of the lower cap decoration 44 is inserted.

The body portion 351 may extend from a lower end of the lower bracket 33 along the left and right direction. To prevent the restriction portion 441 from being out of the inserted state, a vertical height of the body portion 351 may have a predetermined length.

The lower end of the body portion 351 may be inclined toward the lower cap decoration 44. The lower end of the body portion 351 may be inclined downward as it approaches the lower cap decoration 44. Due to this structure, when the lower bracket 33 is mounted on the lower cap decoration 44, the restriction portion 441 of the lower cap decoration 44 may be easily inserted into the opening 357. The lower bracket 33 may be prevented from being damaged in the process of being mounted on the lower cap decoration 44.

The connection portion 352 may be provided by connecting rear surfaces of the lower bracket 33 at both ends of the body portion 351. The connection portion 352 may be disposed to be spaced a set length from both ends of the lower bracket 33 in a central direction.

In addition, the lower mounting portion 35 may further include a top surface portion 354 that shields an upper end of a chamber 36 defined by the body portion 351 and the connection portion 352.

In other words, the lower mounting portion 35 may define the chamber 36 by the body portion 351, the connection portion 352, and the top surface portion 354. Due to the structure of the chamber 36, when assembling the door panel 30, the door panel 30 may be assembled without interfering with other structures. In addition, there is an advantage of improving a gap between the door body 40 and the door body 40, which is caused by a load of the door panel 30.

The hook protrusion 37 protruding backward may be disposed on the body portion 351. The hook protrusion 37 may be disposed to cross the body portion 351 in the left and right direction.

The hook protrusion 37 may be in contact with the front surface of the lower cap decoration 44 in the state in which the lower bracket 33 is mounted on the lower cap decoration 44. In the state in which the hook protrusion 37 is in contact with the lower cap decoration 44, the body portion 351 of the lower mounting portion 35 may be spaced a set interval from the lower cap decoration 44.

In the process of mounting the door panel 30 to which the lower bracket 33 is coupled to the lower cap decoration 44, the hook protrusion 37 may be provided so that the hook protrusion 37 is in contact with the lower cap decoration 44 before being in contact with the lower end of the body portion 351.

Thus, the restriction portion 441 may be more easily inserted into the chamber 36. In addition, in the process of mounting the door panel 30 to the lower cap decoration 44, the lower end of the body portion 351 may be presented from being damaged.

A bracket rib 355 disposed above the lower bracket 33 and extending to be elongated along the left and right direction in which the body portion 351 extends may be disposed on the rear surface of the lower bracket 33.

The bracket rib 355 may be disposed at a position corresponding to the coupling portion 34 of the lower bracket 33. The bracket rib 355 may be provided by protruding from the back of the lower bracket 33 toward the lower cap decoration 44 by a set length.

A plurality of bracket ribs 355 may be provided on the rear surface of the lower bracket 33 and spaced apart from each other in the vertical direction.

The bracket ribs 355 may support the rear surface of the lower bracket 33 in the state in which the lower bracket 33 is bonded to the door panel 30.

In addition, in the bracket rib 355, a rear end of the bracket rib 355 may be in contact with the front end of the lower cap decoration 44 in the state in which the lower bracket 33 is coupled to the lower cap decoration 44. Therefore, the lower bracket 33 may be prevented from being separated from the lower cap decoration 44 due to an external impact or the like.

A reinforcing rib 356 connecting the top surface portion 354 of the lower mounting portion 35 to the bracket rib 355 may be further disposed on the rear surface of the lower bracket 33.

The reinforcing rib 356 may extend from a lower end of the bracket rib 355 toward the top surface portion 354. A plurality of reinforcing ribs 356 may be arranged in a line in the direction in which the bracket ribs 355 extend. There is an advantage in that strength of the lower bracket 33 is further strengthened by the reinforcing rib 356.

A partition portion 361 may be disposed in the chamber 36. The partition portion 361 may extend from the rear surface of the lower bracket 33 toward the body portion 351. A plurality of partition portions 361 may be arranged along the left and right direction in which the body 351 extends.

The partition portion 361 may be provided on each of both sides of the restriction portion 441 in a state where the restriction portion 441 is inserted into the chamber 36.

Thus, the partition portion 361 may prevent the restriction portion 441 from being separated in the state in which the restriction portion 441 is inserted into the chamber 36.

The buffer rib 39 protruding downward is provided on a lower end of the lower mounting portion 35. The buffer rib 39 may protrude downward from the lower end of the body portion 351.

The buffer rib 39 may protrude downward more than the lower end of the lower mounting portion 35. In other words, the buffer rib 39 may protrude more downward than the opening 357 of the lower mounting portion 35.

Due to this structure, in the process of mounting the lower bracket 33 to the lower cap decoration 44, the buffer rib 39 may be in contact with the seating portion 442 disposed first on the lower cap decoration 44 rather than the lower end of the body portion 351.

The lower bracket 33 may be coupled to the lower cap decoration 44 mounted on the door body 40 in the state of being mounted on the door panel 30.

When the door panel 30 is mounted on the lower cap decoration 44, the door panel 30 is coupled from an upper side to the lower end of the lower cap decoration 44. Here, the buffer rib 39 may be seated on the seating portion 442 prior to the lower end of the body portion 351. Thus, the body portion 351 or the lower cap decoration 44 may be prevented from being damaged due to the load of the door panel 30.

In addition, in the state in which the lower bracket 33 is mounted on the lower cap decoration 44, the body portion 351 may be spaced upward from the seating portion 442.

That is, in the state in which the restriction portion 441 is completely inserted into the chamber 36, the lower end of the body portion 351 may be spaced a set distance from the seating portion 442.

Due to this structure, the body portion 351 or the lower cap decoration 44 may be prevented from being damaged due to the load of the door panel 30.

In addition, after the door panel 30 and the door body 40 are coupled to each other, an occurrence of a height difference due to sagging of the door panel 30 due to the load may be improved.

The plurality of the buffer ribs 39 may be arranged in a row in the left and right direction in which the body portion 351 extends. The buffer rib 39 may be disposed at a position corresponding to the partition portion 361.

An inclined portion 38 may be disposed on the lower end of the lower bracket. The inclined portion 38 may obliquely extend forward from the lower end of the rear surface of the lower bracket 33.

The inclined portion 38 may have a structure inclined downward toward the door panel 30 from the rear surface of the lower bracket 33. An end of the inclined portion 38 may be connected to a round portion 358 disposed on a lower end of the front surface of the lower bracket 33.

The inclined portion 38 may be in contact with the decoration inclined portion 443 of the lower cap decoration 44. The inclined portion 38 and the decoration inclined portion 443 may be provided in shapes that match each other. That is, the inclined portion 38 and the decoration inclined portion 443 may be provided so that predetermined areas are in contact with each other.

Due to this structure, the door panel 30 may be prevented from being stepped by sagging due to the load in the state in which the door panel 30 is coupled to the door body 40. Thus, a gap between the door panel 30 and the door body 40 may be improved to improve completeness of the outer appearance of the door.

In addition, a contact area of the lower bracket 33 with the lower cap decoration 44 may increase by the inclined portion 38 and the decoration inclined portion 443. Thus, the door panel 30 may be more stably coupled to the door body 40.

The lower bracket 33 may further include a side surface portion 332 extending backward from each of both ends of the lower coupling portion 34 to define a side surface of the lower bracket 33.

The lower cap decoration 44 includes a decoration coupling portion 445 on which the lower bracket 33 is mounted. The decoration coupling portion 445 includes a front surface portion 444 defining the front surface of the lower cap decoration 44 and a seating portion 442 bent to extend forward from the lower end of the front surface portion 444 so that the lower end of the lower bracket 33 is seated.

The restriction portion 441 protruding upward and inserted into the chamber 36 of the lower bracket 33 may be disposed on the seating portion 442.

The plurality of restriction portions 441 may be arranged along the left and right direction of the mounting portion 442.

The inclined portion may be disposed on an upper end of the restriction portion 441. The inclined portion of the restriction portion 441 may allow the restriction portion 441 to be smoothly inserted into the chamber 36 when the lower bracket 33 is mounted.

The decoration inclined portion 443 may be disposed at a position corresponding to the inclined portion 38 on the front surface of the lower cap decoration 44. For example, the decoration inclined portion 443 may be disposed at the front end of the seating portion 442.

The decoration inclined portion 443 is provided in a shape corresponding to the inclined portion 38. For example, the decoration inclined portion 443 may be inclined forward from an upper end to a lower end of the seating portion 442.

The lower cap decoration 44 may further include an extension portion 446 extending upward from the upper end of the decoration coupling portion 445. The extension portion 446 may be disposed more forward than the front surface portion 444 of the decoration coupling portion 445. That is, the front surface portion 444 of the decoration coupling portion 445 may be disposed to be more recessed backward than the extension portion 446.

The extension portion 446 provides a space in which the lower end of the door body 40 is mounted.

The lower cap decoration 44 may include a bottom portion 447 on which the bottom surface of the door body 40 is seated. In addition, the side surface portion 448 may be disposed at each of both sides of the bottom portion 447 to provide a structure that is capable of being coupled to a lower end of the side decoration 45.

Hereinafter, the mounting structure of the door panel 30 will be described in detail with reference to the drawings.

Figure 16:
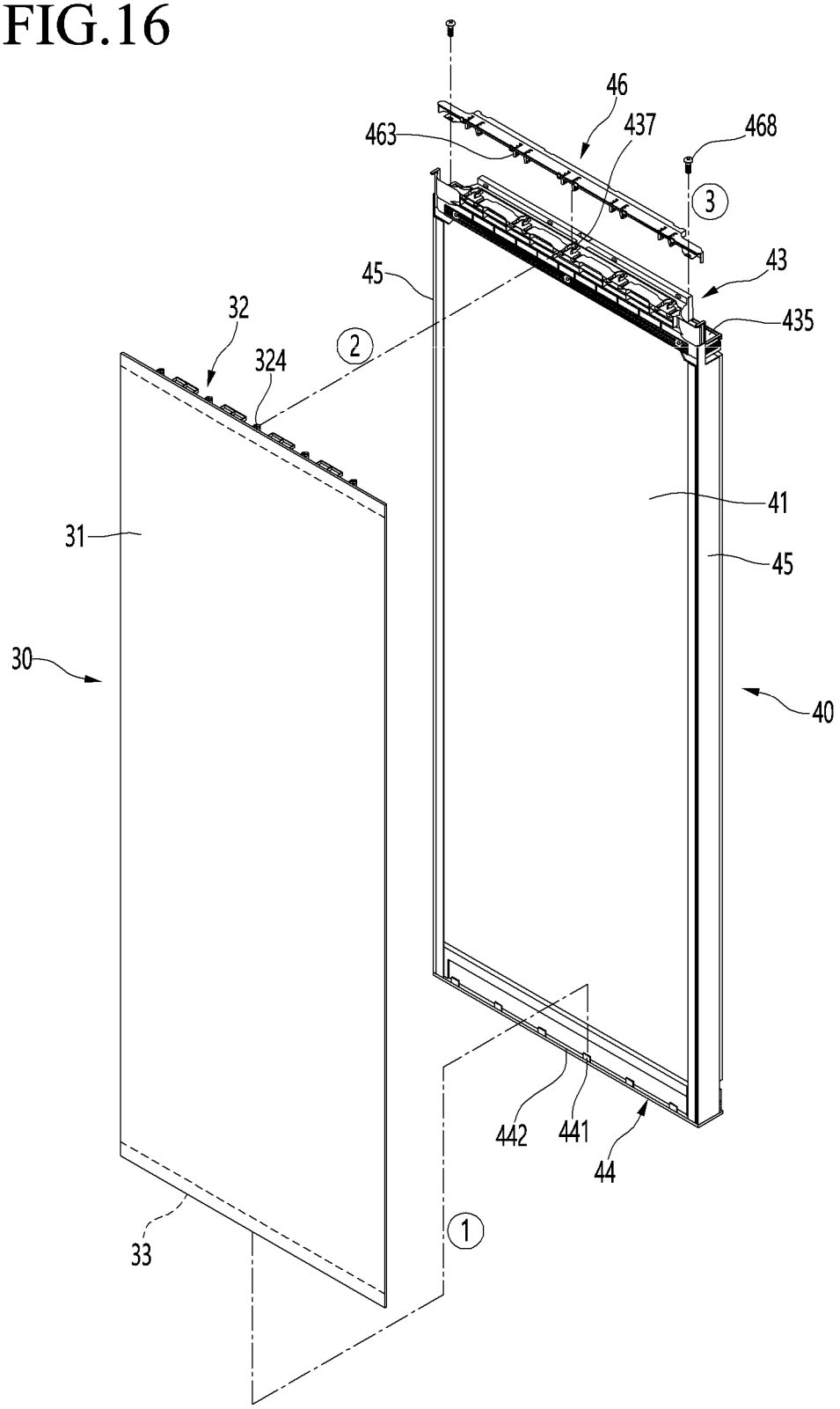
FIG. 16 is an exploded view illustrating a process of mounting a panel on the door.

FIG. 16 is an exploded view illustrating a process of mounting the panel on the door.

As shown in the drawing, the panel 30 may be prepared in a state in which the upper bracket 32 and the lower bracket 33 are attached to the plate 31.

Here, an upper bending portion 311 and a lower bending portion 312 of the front panel 31 may be bent backward from the front panel 31 and inserted into the upper accommodation grove 323 and the lower accommodation grove 341. Therefore, the bending portion of the front panel 31 may not be exposed during transportation and assembly.

In the door body 40, the body plate 31, the door liner 42, the upper cap decoration 43, the lower cap decoration 44, and the side decoration 45 may be coupled to each other, and an insulating material (reference numeral 400 in FIG. 11) may be injected so that the door body 40 is prepared in an assembled state. Here, the decoration cover 46 may be separated from the upper cap decoration 43.

In this state, to mount the panel 30, the panel 30 is brought to the front surface of the door body 40.

The lower end of the panel 30, i.e., the lower bracket 33 is first mounted to the lower cap decoration 44.

The lower end of the lower bracket 33 may be mounted to be supported by the lower cap decoration 44, and the lower end of the panel 30 may be restricted by the lower cap decoration 44.

Next, the upper end of the panel 30, i.e., the upper bracket 32 may be coupled to the upper cap decoration 43.

In a state in which the lower end of the panel 30 is restricted by the lower cap decoration 44, the upper end of the panel 30 rotates toward the front surface of the door body 40.

While the rear surface of the panel 30 is in close contact with the front surface of the door body 40, the upper bracket 32 may be coupled to the upper cap decoration 43. Here, both left and right ends of the panel 30 are in contact with the side decoration 45.

The restriction of the lower end of the panel 30 and the coupling of the upper end of the panel 30 may be sequentially performed. The panel 30 may be mounted through one operation of rotating the upper end of the panel 30 so as to be coupled to the upper cap decoration 43 while seating the lower end of the panel 30 on the lower cap decoration 44 so that the lower end of the panel 30 is supported.

In the state in which the panel 30 is disposed on the door body 40, the decoration cover 46 is mounted on the top surface of the upper cap decoration 43. The decoration cover 46 may be further fixed so that the upper bracket 32 and the upper cap decoration 43 remain in the state of being coupled to each other while being mounted on the upper cap decoration 43.

Figure 17:
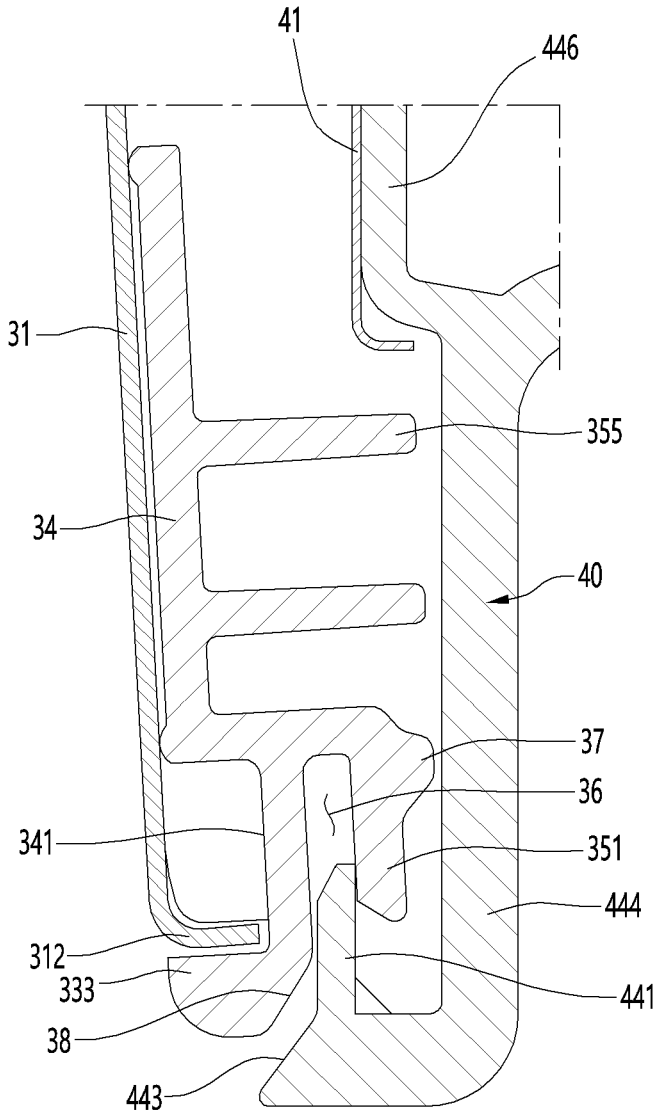
FIG. 17 is a cross-sectional view illustrating an operation for coupling the door body to the door panel.
Figure 18:
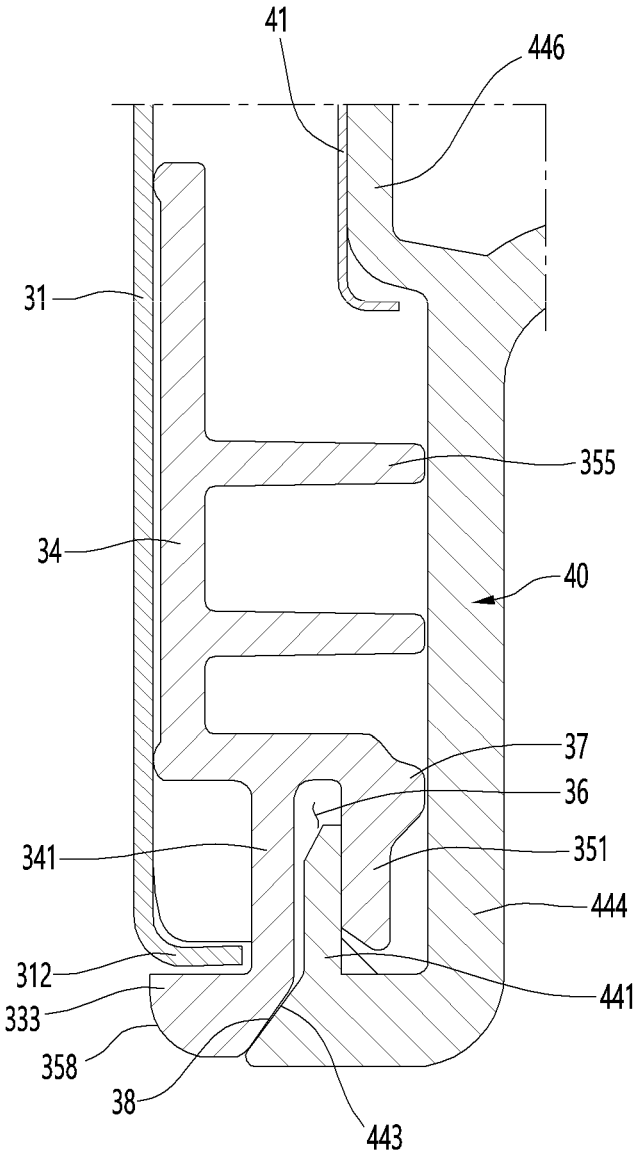
FIG. 18 is a cross-sectional view illustrating a state in which the door panel is coupled to the door body.

FIG. 17 is a cross-sectional view illustrating an operation for coupling the door body to the door panel. Also, FIG. 18 is a cross-sectional view illustrating a state in which the door panel is coupled to the door body.

In the door panel 30, the upper bracket 32 may be coupled to the upper cap decoration 43 in the state in which the lower bracket 33 is hooked and restricted by the lower cap decoration 44. As the decoration cover 46 is mounted above the upper cap decoration 43, the door panel 30 may be completely restricted.

In detail, first, the door panel 30 may be tilted so that the restriction portion 441 of the lower cap decoration 44 is inserted into the chamber 36 of the lower bracket 33.

Here, as illustrated in FIG. 17, a predetermined interval may be defined between the body portion 351 of the lower bracket 33 and the decoration coupling portion 445 of the lower cap decoration 44 by the hook protrusion 37 of the lower bracket 33.

When the door panel 30 is erected perpendicular to the ground in the state in which the hook protrusion 37 is in contact with the lower cap decoration 44, the restriction portion 441 may be accommodated in the chamber 36 through the opening 357.

Here, when the restriction portion 441 is inserted into the chamber 36, the buffer rib 39 is in contact with the seating portion 442 first.

When the door panel 30 is perpendicular to the ground, as illustrated in FIG. 18, the restriction portion 441 is completely drawn into the chamber 36.

An upper end of the door panel 30 may be fixed in a state in which a lower end of the door panel 30 is mounted on the lower cap decoration 44.

When the upper end of the door panel 30 moves backward to fix the upper end of the door panel 30, the lower end of the door panel 30 rotates in the restricted state by using the lower end of the door panel 30 as an axis.

When the upper end of the door panel 30 moves backward, the mounting protrusion 324 protruding from the upper bracket 32 moves backward. Also, when the upper end of the door panel 30 moves so that the mounting protrusion 324 is inserted into the protrusion accommodation portion 432, the upper end of the door panel 30 is fixed to the upper cap decoration 43.

Figure 19:
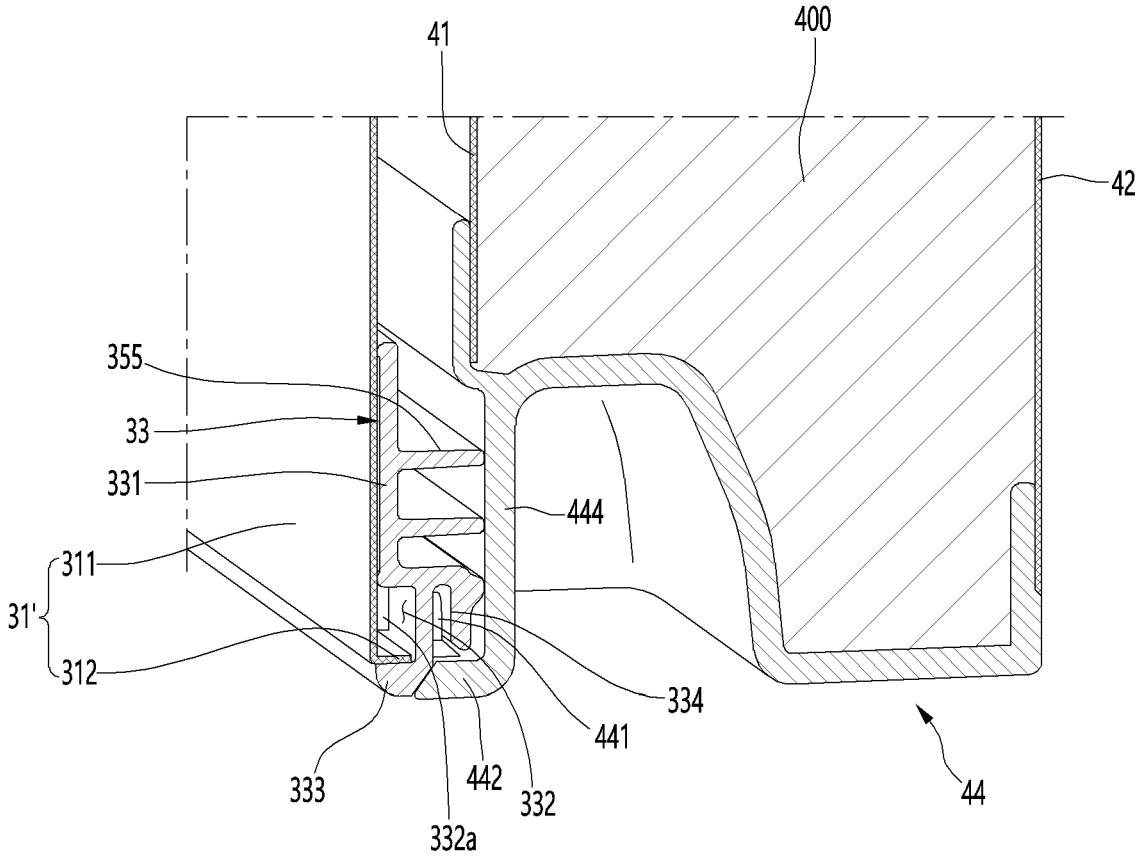
FIG. 19 is a cutaway perspective view taken along line 19-19' of FIG. 2.

FIG. 19 is a cutaway perspective view taken along line 19-19 of FIG. 2.

Referring to FIG. 19, to mount the panel on the door body, the lower end of the panel is coupled to the lower cap decoration 44.

A lower support portion 442 protruding forward may be disposed on the lower end of the lower cap decoration 44. In addition, the lower support portion 442 may protrude forward at a height corresponding to the front surface of each of the side decoration 45 and the panel 30.

A restriction portion 441 protruding upward may be disposed on the lower support portion 442. The restriction portion 441 may be provided in plurality, which protrude at regular intervals along the lower support portion 442. Also, the restriction portion 441 may be spaced apart from the lower front surface portion 444.

When the panel 30 is mounted, the restriction portion 441 may be inserted and mounted to the lower end of the panel 30, i.e., to the lower mounting portion 35 of the lower bracket 33. The restriction portion 441 may be inserted into the opened bottom surface of the lower mounting portion 35. In the mounted state, the lower end of the panel may be supported by the lower support portion 442, and simultaneously, the restriction portion 441 may be restricted to the lower mounting portion 35 so that the lower portion of the panel 30 is fixed to the door body 40.

Here, the bracket rib 355 of the lower bracket 33 may be in contact with the lower front surface portion 444 of the lower cap decoration 44, and thus, even though a load or compressive force may be applied to the lower front surface of the panel 30, the panel 30 may not be deformed or damaged.

In addition, in the state in which the panel 30 moves downward from the upper side so that the lower end of the panel 30 is fixedly mounted to the lower cap decoration 44, the upper end of the panel 30 may be fixed to the upper cap decoration 43 by rotating the upper end of the panel 30 by using the lower end of the panel 30 as the axis.

Figure 20:
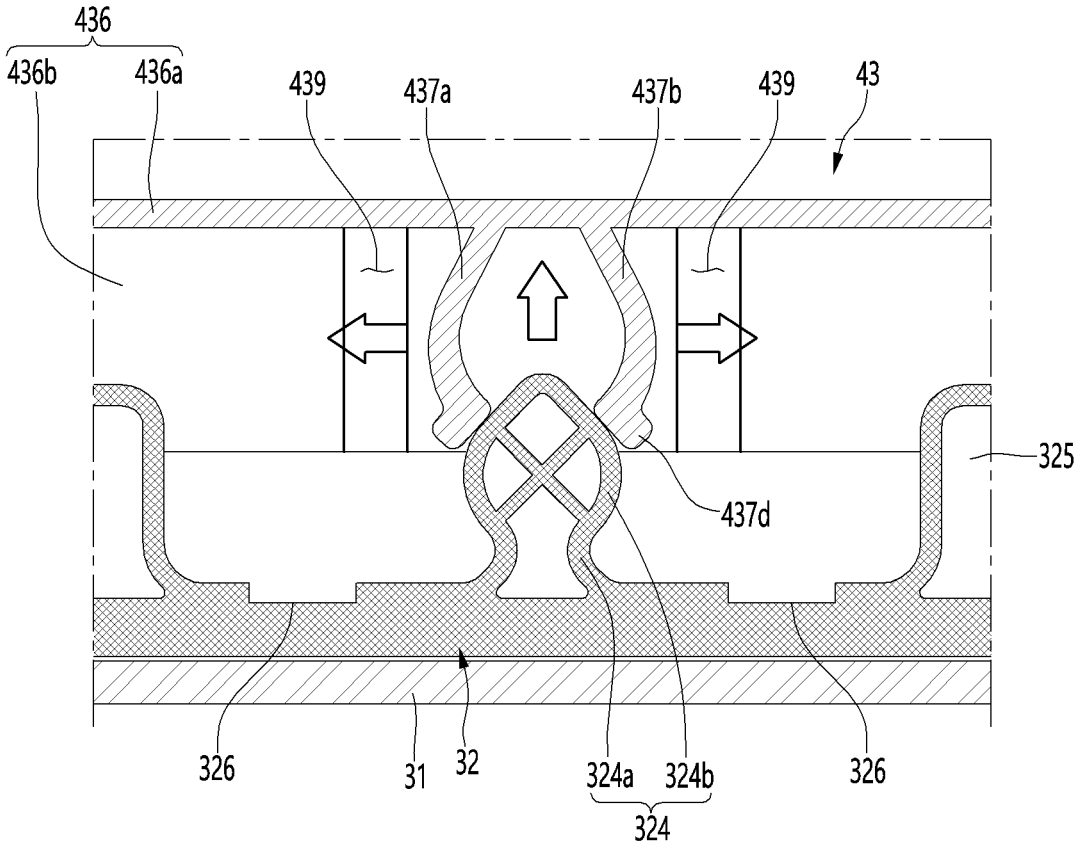
FIG. 20 is a cross-sectional view illustrating a state before the upper bracket and the upper cap decoration are coupled to each other.
Figure 21:
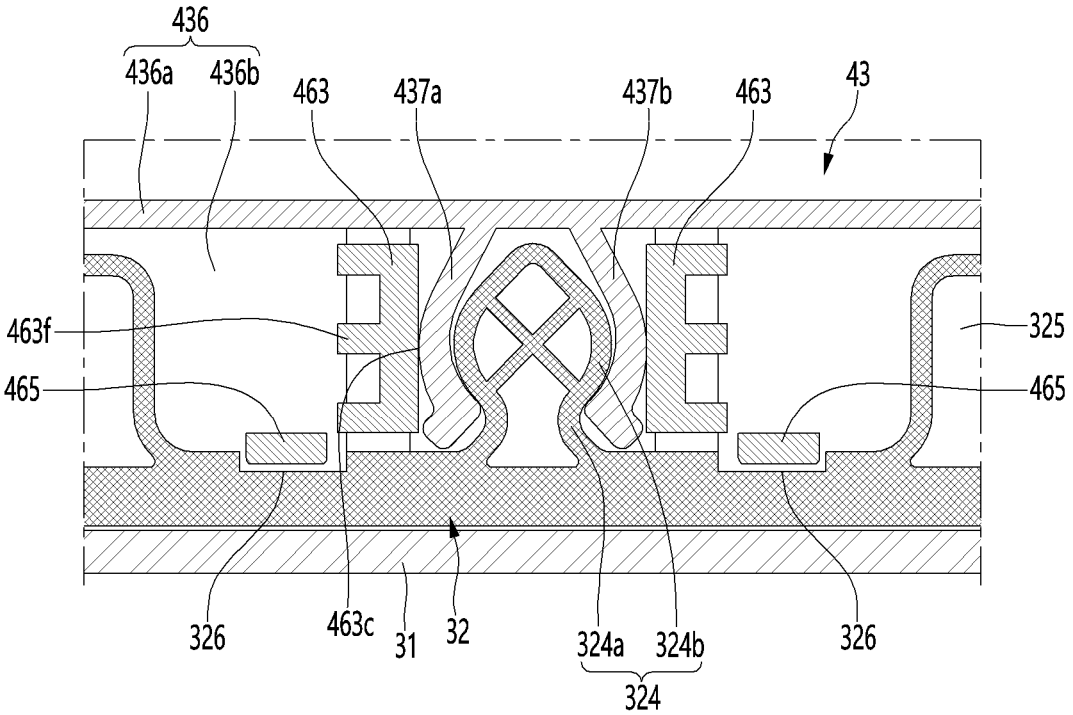
FIG. 21 is a cross-sectional view illustrating a state in which the upper bracket, the upper cap decoration, and the decoration cover are coupled to each other.

FIG. 20 is a cross-sectional view illustrating a state before the upper bracket and the upper cap decoration are coupled to each other. FIG. 21 is a cross-sectional view illustrating a state in which the upper bracket, the upper cap decoration, and the decoration cover are coupled to each other.

As illustrated in the drawing, in the state in which the lower end of the panel 30 is mounted on the lower cap decoration 44, it becomes the same state as FIG. 12 before the upper end of the panel 30 is coupled to the upper cap decoration 43.

In this state, to fix the upper end of the panel 30, the upper end of the panel 30 moves backward. Here, the lower end of the panel 30 is in the restricted state, and the panel 30 rotates by using the lower end of the panel 30 as the axis.

When the upper end of the panel 30 moves backward, the mounting protrusion 324 protruding from the upper bracket 32 moves backward. The mounting protrusion 324 is disposed outside the protrusion accommodation portion 437.

In addition, here, the mounting guide 325 may be seated on the seating portion 438, and thus, the mounting protrusion 324 may be aligned so as to be accurately inserted toward the protrusion accommodation portion 437.

In this state, when the upper end of the panel 30 further moves backward, the insertion portion 324*a* of the mounting protrusion 324 may be inserted into the opening of the inlet portion 437*d*. In the process of inserting the insertion portion 324*a* through the inlet portion 437*d* and being inserted into the fixing portion 437*c*, the accommodation members 437*a* and 437*b* may be elastically deformed while being widened to both left and right sides. Thus, the mounting protrusion 324 may be press-fitted into the protrusion accommodation portion 437.

When the mounting protrusion 324 is completely inserted between the accommodation members 437*a* and 437*b*, the accommodation members 437*a* and 437*b* may be elastically restored so that the fixing portion 437*c* is in close contact with the insertion portion 324*a* to surround the insertion portion 324*a*.

The inlet portion 437*d* is may be in close contact with an outer surface of the extension portion 324*b* so that the entire outer surface of the mounting protrusion 324 is completely in close contact with the inner surface of the accommodation members 437*a* and 437*b* to allow the mounting protrusion 324 to be firmly fixed to the protrusion accommodation portion 437.

When the rear surface of the panel 30 is in close contact with the front surface of the door body 40, the mounting protrusion 324 may be completely inserted into the protrusion accommodation portion 437.

In this state, the panel 30 may be temporarily fixed to the front surface of the door body 40, and the decoration cover 46 may be mounted. In the process of attaching the decoration cover to the upper cap decoration 43, the restriction portion 463 restricts the elastic deformation of the protrusion accommodation portion 437.

Figure 22:
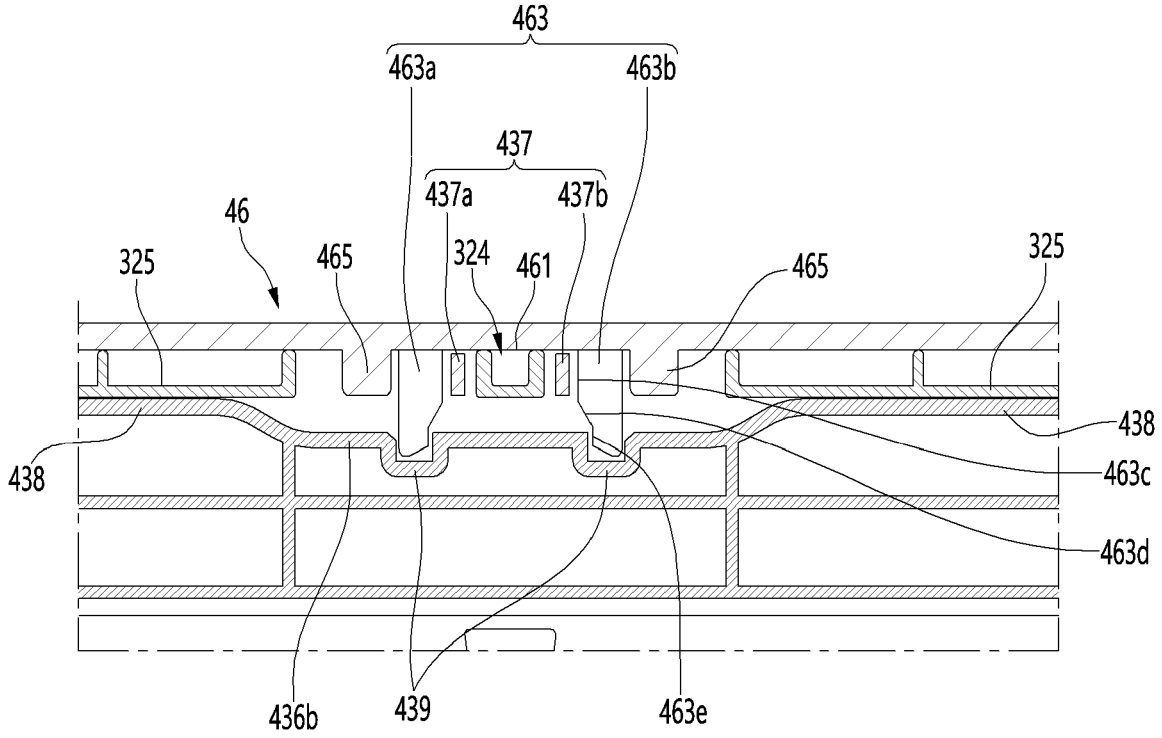
FIG. 22 is a cross-sectional view taken along line 22-22' of FIG. 2.
Figure 23:
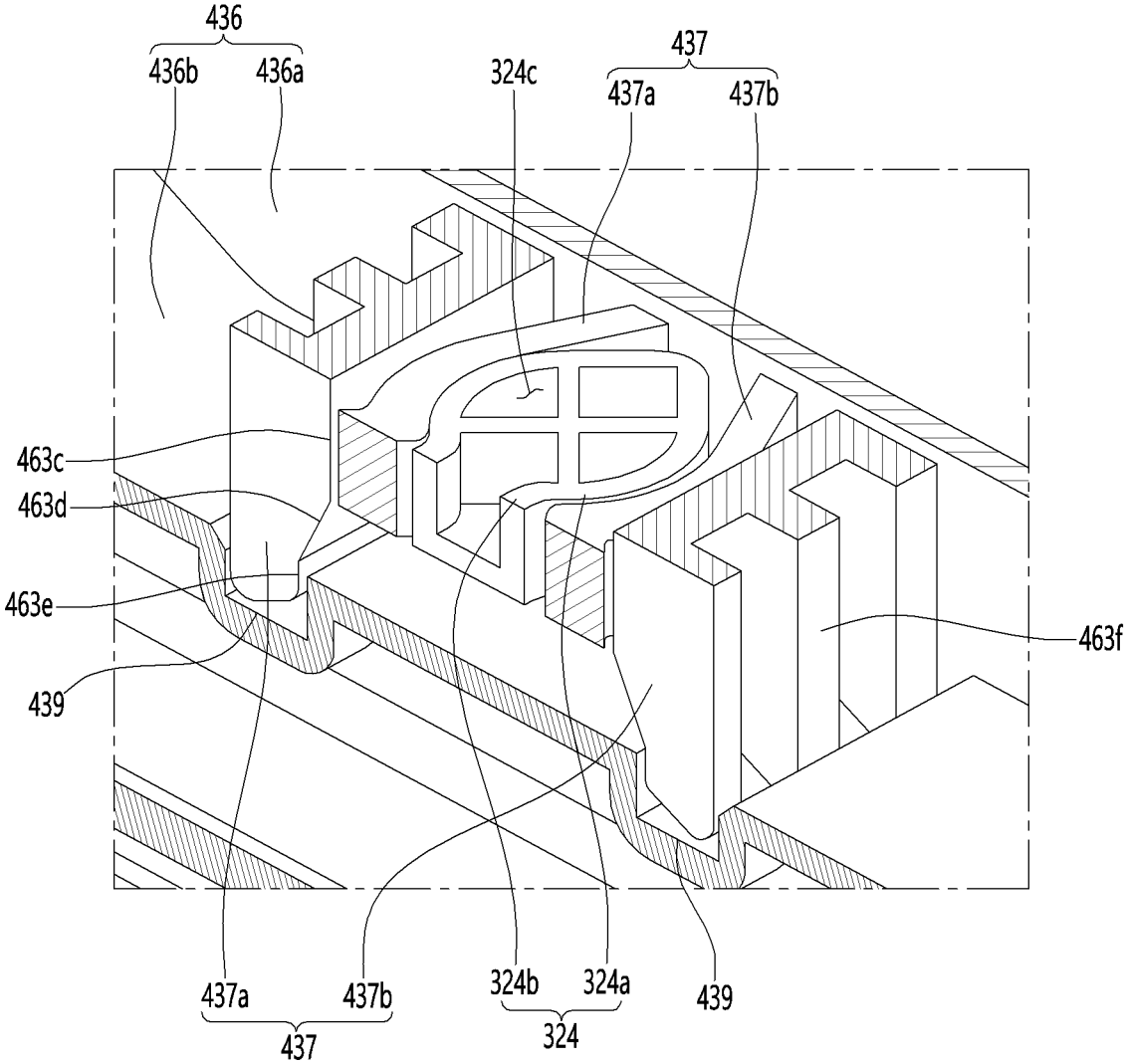
FIG. 23 is a cutaway perspective view illustrating a state in which the upper bracket, the upper cap decoration, and the decoration cover are coupled to each other.

FIG. 22 is a cross-sectional view taken along line 22-22' of FIG. 2. Also, FIG. 23 is a cutaway perspective view illustrating a state in which the upper bracket, the upper cap decoration, and the decoration cover are coupled to each other.

As illustrated in the drawing, when the upper end of the panel 30 is fixed by inserting the mounting protrusion 324 into the protrusion accommodation portion 437, the panel 30 may be in the state of being mounted on the front surface of the door body. In addition, in this state, the decoration cover 46 may be attached to the upper cap decoration 43 to restrict the panel 30 so as to maintain in the attached state to the door body 40.

In detail, the decoration cover 46 is mounted to shield the decoration opening 430 of the upper cap decoration 43. That is, the decoration cover 46 may be mounted in a direction crossing the direction in which the mounting protrusion 324 is inserted.

When the decoration cover 46 is mounted, the restriction portion 463 extending downward from the bottom surface of the decoration cover 46 may move in a direction crossing the protrusion accommodation portion 437, and in this process, the restriction portion 463 may restrict the protrusion accommodation portion 437.

In detail, in the state in which the insertion portion 324*a* of the mounting protrusion 324 is inserted into the protrusion accommodation portion 437, inner surfaces of the restriction members 463*a* and 463*b* may press and fix outer surfaces of the accommodation members 437*a* and 437*b*.

Here, the upper portion 463*c* of the restriction portion may be in contact with the most protruding outer surfaces of the accommodation members 437*a* and 437*b* to prevent the accommodation members from being spread. Thus, in the state in which the restriction members 463*a* and 463*b* are in contact with the outer surfaces of the accommodation members 437*a* and 437*b*, the accommodation members 437*a* and 437*b* may not be deformed outward.

In the state in which elastic deformation of the accommodation members 437*a* and 437*b* is impossible, the mounting protrusion 324, i.e., the insertion portion 324*a* may maintain in the state of being inserted into the protrusion accommodation portion 437 so as not to be separated from the accommodation portion space 437*c*.

That is, in the state in which the decoration cover 46 is mounted, the mounting protrusion 324 may remain in the state of being inserted into the protrusion accommodation portion 437, and the deformation of the accommodation members 437*a* and 437*b* may be prevented to fundamentally prevent the mounting portion 324 from being arbitrarily separated 324.

Therefore, even if the door 20 is repeatedly opened or closed, or an impact is applied when the door 20 is opened or closed, the panel 30 may not be separated to maintain in the firmly and stably mounted state.

In addition, when the decoration cover 46 is mounted, the restriction portion 463 may move in a direction crossing the protrusion accommodation portion 437 so that the lower end of the restriction portion 463 is inserted into the restriction portion accommodation groove 439, and thus, the restriction portion 463 is fixed.

When the decoration cover 46 is completely mounted, the lower restriction portion 463*e* may be accommodated in the restriction portion accommodation groove 439. Here, the lower restriction portion 463*e* and the protrusion accommodation portion 437 may have sizes corresponding to each other so that the restriction portion 463 is fitted into the protrusion accommodation portion 437.

In this state, even if a lateral load is applied to the restriction portion 463, the restriction portion 463 may be prevented from being widened or deformed. That is, even if force is forcibly applied to the mounting protrusion 324 in a state in which the restriction portion 463 presses the outer surface of the protrusion accommodation portion 437, the restriction portion 463 may be fixed by the restriction portion accommodation groove 439 to maintain in the fixed state.

Therefore, the protrusion accommodation portion 437 may not be deformed, and the mounting protrusion 324 may not be separated from the protrusion accommodation portion 437, and as a result, the panel 30 may be more firmly fixed so as not to be arbitrarily separated.

A screw 468 may be coupled to the cover coupling portion 467 so that the decoration cover 46 is coupled to the upper cap decoration 43 in the firmed state. As described above, as long as the decoration cover 46 remains in the state of being coupled to the upper cap decoration 43, the panel 30 may be prevented from being arbitrarily and thus may remain in the firmly coupled state.

If only the decoration cover 46 is separated for maintenance or replacement of the panel 30, the panel 30 may be simply separated without a separate tool or tool, and a necessary operation may be quickly performed.

There may be various other embodiments other than the aforementioned embodiments. Another embodiment is characterized in that a plate constituting the panel is made of a metal material.

In another embodiment, other structures except for the plate are the same, and for the same components, specific drawings may be omitted, the same reference numerals are used, and detailed descriptions thereof may be omitted. Hereinafter, another embodiment of the present disclosure will be described with reference drawings.

Figure 24:
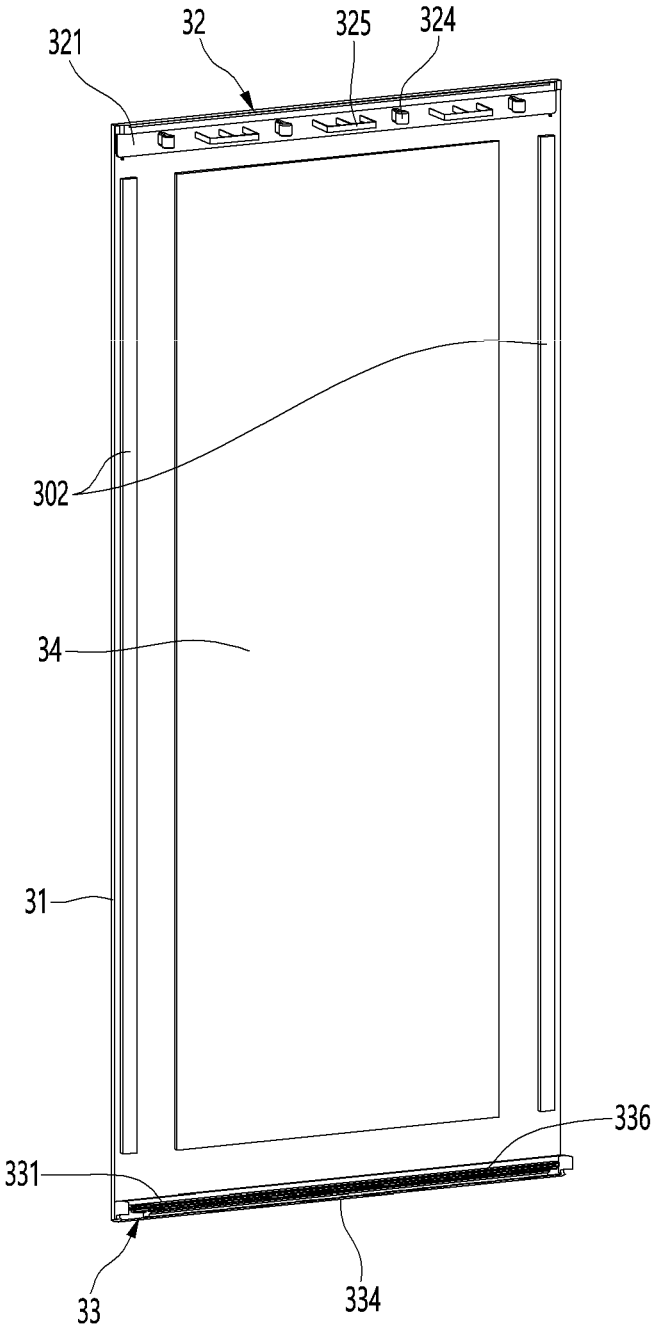
FIG. 24 is a rear perspective view illustrating a panel of a door according to another embodiment.
Figure 25:
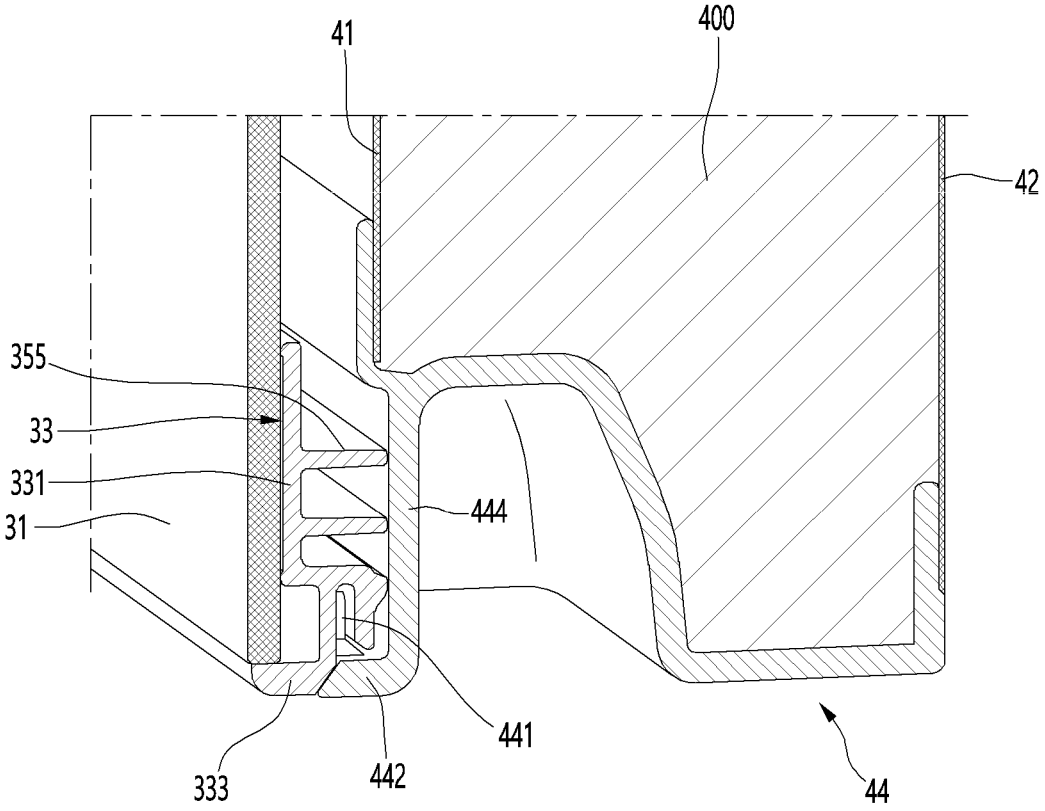
FIG. 25 is a cutaway perspective view of the door.

FIG. 24 is a rear perspective view illustrating a panel of a door according to another embodiment. Also, FIG. 25 is a cutaway perspective view of the door.

As illustrated in the drawings, a panel 30 according to another embodiment may include a plate-shaped plate 31' and an upper bracket 32 and a lower bracket 33, which are provided on upper and lower ends of a rear surface of the plate 31'.

Here, alternatively, the plate 31 may be made of a tempered glass material and may be provided to have a color and texture to define the front surface of the door 20, i.e., the outer appearance of the front surface of the refrigerator 1. In addition, the plate 31 may be made of various materials such as ceramic, metal, and plastic as necessary.

An adhesive member such as adhesive or double-sided tape may be provided on a lower coupling portion 331 and mounted on a rear surface of the plate 31.

In addition, an adhesive may be applied to the front surface of the upper coupling portion 321, or a member for adhesion such as a double-sided tape may be disposed. Thus, the coupling portion 321 may maintain a state for the complete adhesion to the rear surface of the plate 31.

When the plate 31' is made of glass, a lower rib 342 may be omitted.

There may be various other embodiments other than the aforementioned embodiments. According to another embodiment of the present disclosure, a panel defining an outer appearance may be applied to other home appliances other than a refrigerator to change an outer appearance of a front surface of the home appliance.

Another embodiment of the present disclosure may have the same structure as the aforementioned embodiment except for the size and shape of a panel and an application target of the panel, and thus the same components as in the aforementioned embodiment use the same reference numeral, and a detailed description thereof may be omitted.

The following embodiments are the same as the aforementioned embodiments in configurations of a panel, a cap decoration, and a decoration cover, and thus for detailed components, reference may be made to the description and drawings of the aforementioned embodiment, and a detailed description thereof is omitted to avoid repetition. Hereinafter, another embodiment of the present disclosure will be described with reference drawings.

Figure 26:
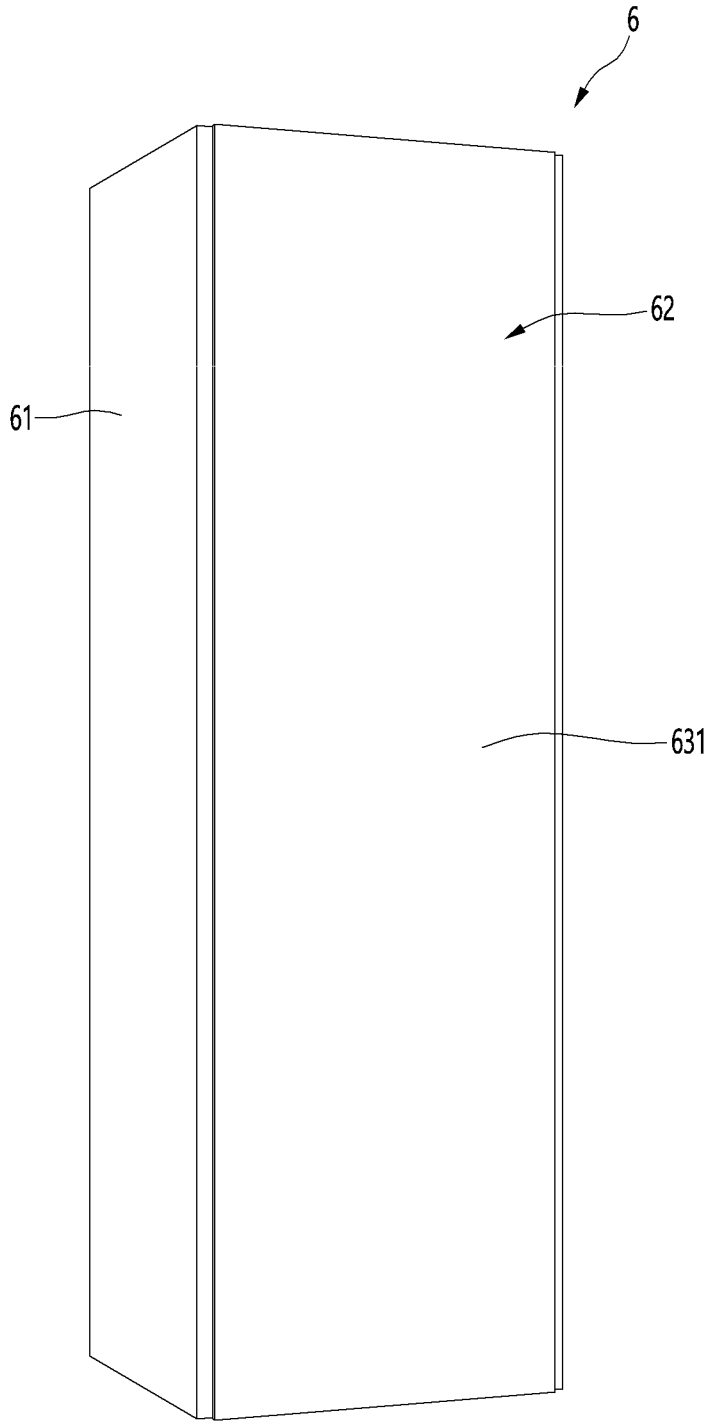
FIG. 26 is a perspective view illustrating a clothing management device according to further another embodiment.
Figure 27:
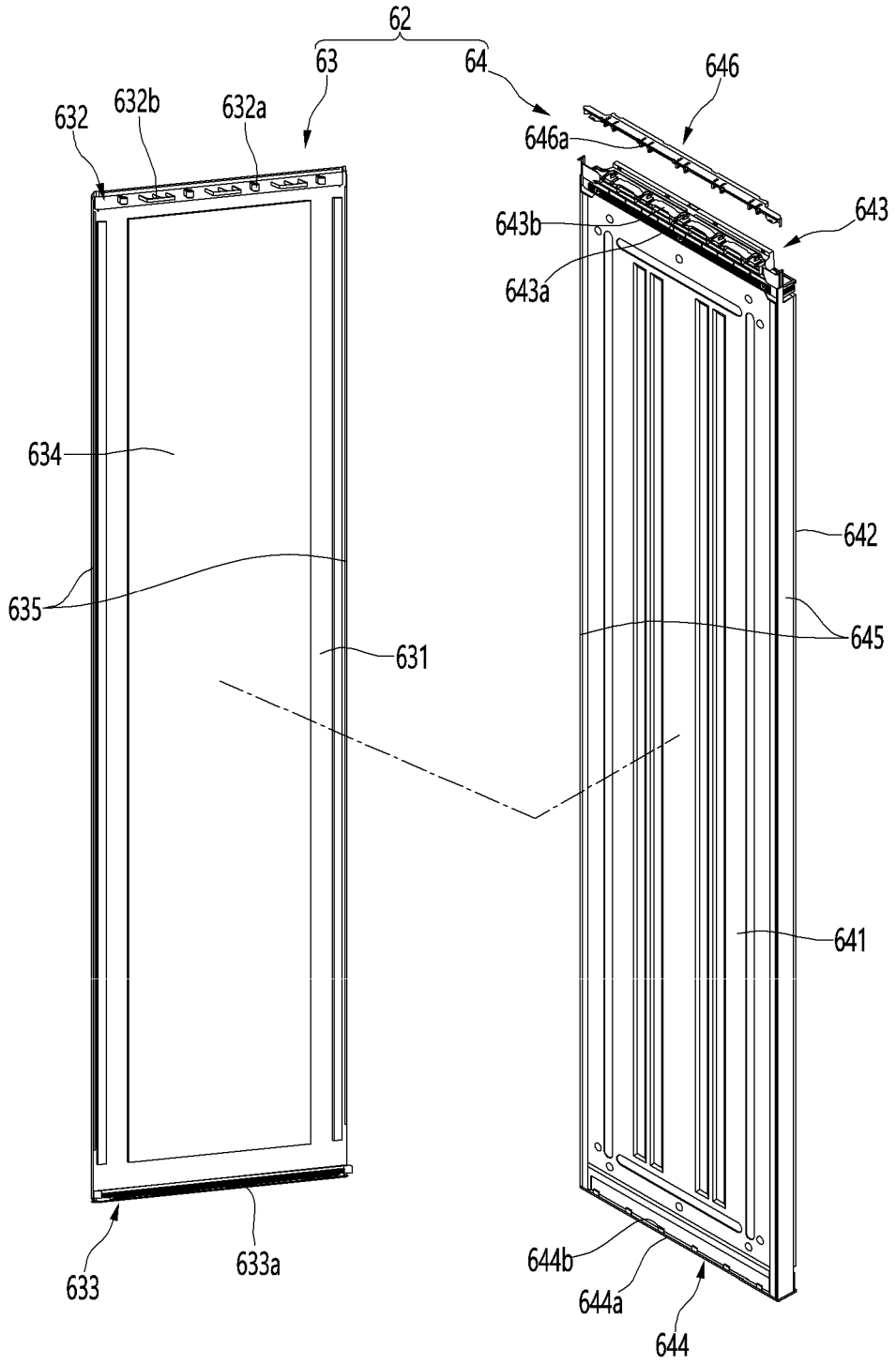
FIG. 27 is a perspective view illustrating a panel of a door and a door body of the clothing management device are separated from each other.

FIG. 26 is a perspective view illustrating a clothing management device according to further another embodiment. Also, FIG. 27 is a perspective view illustrating a panel of a door and a door body of the clothing management device are separated from each other.

As shown in the drawings, an outer appearance of a clothing manager 6 according to further another embodiment of the present disclosure may be formed by a case 61 forming a clothing accommodation space, and a door 62 for opening and closing an open front surface of the case 61.

In general, the case 61 may include a clothing accommodation space for accommodating clothing, and a heat pump, a water tank, a steam generator, and an air circulation fan may be provided within a machine room separately formed from the clothing accommodation space.

A discharge port for discharging steam generated from the steam generator and dried air heated by the heat pump, and an absorption port for absorbing air from the clothing accommodation space may be formed inside the clothing accommodation space.

The door 62 may be rotatably mounted on the case 61, and in the state in which the door 62 is closed, the door 62 may form an outer appearance of the front surface of the clothing manager 6. The door 62 may include a door body 64 for opening and closing the clothing accommodation space, and a panel 63 mounted on the door body 64 to form a front surface of the door 62.

The panel 63 as a whole may have the same structure as the panel 30 of the foregoing embodiment except for a size. The panel 63 may include a plate 631 defining a front surface, an upper bracket 632 mounted on an upper end of a rear surface of the plate 631, and a lower bracket 633 mounted on a lower end of the rear surface of the plate 631.

In the upper bracket 632, a mounting protrusion 632*a* inserted into a protrusion accommodation portion 643*a* defined in the upper cap decoration 643 may protrude backward. In addition, a mounting guide 632*b* seated on a mounting portion 643*b* disposed on the upper cap decoration 643 may protrude backward from the upper bracket 632.

Since structures of the mounting protrusion 632*a* and the mounting guide 632*b* and structures of the protrusion accommodation portion 643*a* and the seating portion 643*b* are the same as those according to the foregoing embodiment, their detailed descriptions will be omitted.

In addition, a lower mounting portion 633*a* supported by the lower support portion 644 of the lower cap decoration 644 and coupled to the hook protrusion 644*a* may be disposed on the lower bracket 633.

A buffer member 634 that is in contact with the body plate 641 may be provided on a rear surface of the plate 631. In addition, magnets 635 capable of being attached by magnetic force to the body plate 641 made of steel may be provided on both left and right sides of the rear surface of the plate 631, respectively.

The front plate 641 may be provided on a front surface of the door body 64 to define the front surface of the door body 64, and a rear plate may be provided on a rear surface of the door body to define the rear surface of the door body 64. In addition, a side decoration 642 extending in a vertical direction along both left and right ends of the door body 64 may be provided. A top surface of the door body 64 may be disposed by an upper cap decoration 643 for connecting upper ends of the side decorations 642 disposed at both the right and left sides, and a bottom surface of the door body 64 may be disposed by a lower cap decoration 644 that connects lower ends of the side decorations 642 disposed at both the right and left sides.

The upper cap decoration 643 and the lower cap decoration 644 may have the same structure as the upper cap decoration 43 and the lower cap decoration 44 according to the foregoing embodiment except for a size and arrangement.

Thus, a decoration opening shielded by a decoration cover 646 may be defined in a top surface of the upper cap decoration 643, and a recessed space, i.e., a decoration recessed portion may be defined inside the decoration opening, and a protrusion accommodation portion 643*a*, into which the mounting protrusion 632*a* of the upper bracket 632 is inserted, and a seating portion 643*b*, into which a mounting guide 632*b* is seated may be provided inside the decoration recessed portion.

In addition, a restriction portion 646*a* extending downward may be disposed on a bottom surface of the decoration cover 646. When the decoration cover 646 is mounted, the restriction portion 646*a* may be in contact with the protrusion accommodation portion 643*a* to maintain in the restricted state between the mounting protrusion 632*a* and the protrusion accommodation portion 643*a*. Since the structures and shapes of the decoration cover 646 and the restriction portion 646*a* are also the same as those of the foregoing embodiment, their detailed descriptions will be omitted.

The lower bracket 633 provided on the lower end of the panel 63 may be hooked and restricted by the lower cap deco 644, and in a state in which the lower end of the panel 63 is supported on the lower cap deco 644, an upper end of the panel 63 may rotate to allow the upper bracket 632 provided on the upper end of the panel 63 to be coupled to the upper cap decoration 643. Here, the upper bracket 632 and the upper cap decoration 643 may be fixed to each other by coupling the mounting protrusion 632*a* and the protrusion accommodation portion 643*a*.

In addition, when the decoration cover 646 is mounted on the upper cap decoration 643, the restriction portion 646*a* of the decoration cover 646 may restrict the protrusion accommodation portion 643*a*, and the restriction between the mounting protrusion 632*a* and the protrusion accommodation portion 643*a* may be maintained so that a weight is fixed so as not to be separated.

In this state, there is an advantage in that the panel 63 is not separated arbitrarily even when the door 62 is repeatedly opened and closed. In addition, in the case in which the decoration cover 646 is detached when the panel 63 is mounted or detached, the panel 63 may be simply separated from the door body 64 without the separate tool. Therefore, the user may easily change the outer appearance of the clothing manager 6.

In the home appliance according to the embodiment of the present disclosure, the following effects may be expected.

The refrigerator according to the embodiment may have the advantage in that the panel defining the front surface of the door is easily separated from and mounted on the door body to change the outer appearances of the door and the home appliance according to the user's preference.

The mounting protrusion protruding backward may be disposed on the upper bracket disposed on the upper end of the panel, and the protrusion accommodation portion into which the mounting protrusion is press-fitted may be provided in the upper cap decoration of the door body so that the panel is mounted on the door body through the simple manipulation for moving the panel backward.

In addition, the lower bracket may be provided on the lower end of the panel, and the lower bracket may be restricted in the state of being supported on the lower cap decoration of the door body. Thus, the panel may be mounted on the door body through the simple manipulation that rotates the upper end of the panel backward in the state in which the heavy panel is supported on the lower cap decoration to significantly improve the convenience of the assembly and separation of the panel.

In addition, the mounting protrusion may be integrated when the panel bracket is molded, and the outer appearance of the door may be defined by the panel bracket, and also the door panel may be fixedly mounted. Therefore, there may be the advantage in that the number of components of the product is reduced to reduce the number of processes in the operation, as well as the manufacturing cost may be reduced.

Also, when the decoration cover is mounted in the state in which the door panel is mounted, the restriction portion of the decoration cover may restrict the protrusion accommodation portion at the outside to prevent the protrusion accommodation portion from being deformed. Thus, the state in which the mounting protrusion is inserted into the protrusion accommodation portion may be maintained to prevent the mounting protrusion from being arbitrarily separated from the protrusion accommodation portion, thereby expecting the additional fixing effect.

In addition, when the decoration cover is mounted, the restriction portion may cross the protrusion accommodation portion and then may be inserted into the restriction portion accommodation groove. That is, the lower end of the restriction portion may be fixed in the state of being inserted into the inside of the restriction portion accommodation groove defined in the upper cap decoration.

The restriction portion may be fixed in the state of being inserted into the restriction portion accommodation groove, and even if the load is applied from the protrusion accommodation portion, the state of restricting the protrusion accommodation portion may be maintained without being deformed or damaged. Therefore, there may be the advantage in ensuring that the mounting protrusion is firmly fixed without the mounting protrusion separated from the protrusion accommodation portion.

Due to such the fixing structure, the panel may be maintained in the more rigidly mounted state on the door body, and the panel may be prevented from being separated from the door body even if it is repeatedly opened and closed, or the large load is applied during the opening and closing.

In addition, to separate and mount the panel, if only the decoration cover is separated, the panel may be easily separated or mounted without the separate tool, and thus, the convenience of separation or mounting of the panel may be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A appliance comprising:

a cabinet defining a storage space; and a door configured to open and close the storage space, wherein the door comprises:

a door body, a door panel defining a front surface of the door, a cap decoration defining a lower surface of the door body, and a bracket provided at a rear surface of the door panel and configured to be coupled to the cap decoration, wherein the cap decoration comprises:

a seating portion, and a restriction portion protruding upward from the seating portion, wherein the bracket comprises a mounting portion that defines a space configured to receive the restriction portion, wherein the mounting portion comprises:

a body portion extending toward the seating portion along a rear side of the space, and a buffer rib protruding downward from the body portion, and wherein the buffer rib is configured to, based on the bracket being coupled to the cap decoration, contact the seating portion, wherein the bracket includes an inclined portion that is inclined toward the door panel from a lower end of bracket, wherein the cap decoration includes a decoration inclined portion that faces the inclined portion, wherein the bracket includes a round portion at a first end of the inclined portion, and wherein the round portion is configured to define at least a portion of the front surface of the door.

2. The appliance according to claim 1, wherein the cap decoration defines a recess and provides the seating portion at the recess.

3. The appliance according to claim 2, wherein the body portion is spaced apart from a front surface of the bracket, and wherein the mounting portion further comprises:

a connecting portion extending from both side ends of the body portion toward the front surface of the door, and an opening into which the restriction portion is inserted.

4. The appliance according to claim 3, the body portion is configured to, based on the restriction portion being inserted into the mounting portion, be spaced apart from the seating portion.

5. The appliance according to claim 3, wherein the mounting portion extends along a left and right direction in which the body portion extends and includes a hook protrusion protruding toward the cap decoration, and wherein the hook protrusion is configured to, based on the bracket being coupled to the cap decoration, contact a front surface of the cap decoration.

6. The appliance according to claim 5, wherein the bracket includes a partition portion disposed inside the mounting portion and connecting the front surface of the bracket to the body portion.

7. The appliance according to claim 1, wherein the bracket includes:

a coupling part configured to be coupled to the door panel at a front side of the door panel, and an accommodation groove recessed at a first end of the coupling part and including a plurality of ribs arranged in a left-right direction in which the bracket extends.

8. The appliance according to claim 7, wherein the door panel is recessed at a first end to define a bending portion configured to be inserted between the accommodation groove and the buffer rib.

9. The appliance according to claim 1, wherein the bracket further includes a bracket rib protruding rearward from a rear surface of the bracket and extending in a direction in which the mounting portion extends.

10. The appliance according to claim 1, wherein the door comprises:

an upper bracket disposed at the rear surface of the door panel and providing a mounting protrusion that protrudes rearward, an upper cap decoration providing a protrusion accommodation portion that defines an opening at a front side to receive the mounting protrusion, and a decoration cover mounted on an upper portion of the upper cap decoration to define an outer surface of the upper cap decoration, and wherein the decoration cover is mounted in a direction crossing an insertion direction of the mounting protrusion to block the protrusion accommodation portion and the mounting protrusion from being separated from each other.

11. The appliance according to claim 10, wherein the upper cap decoration defines a decoration opening, and wherein a shape of the decoration cover corresponds to the decoration opening.

12. The appliance according to claim 11, wherein the decoration cover includes a pair of restriction portions extending to an inside of the decoration opening, and wherein the pair of restriction portions are configured to block the protrusion accommodation portion and the mounting protrusion from being separated from each other.

13. The appliance according to claim 12, wherein the mounting protrusion is configured to, based on the mounting protrusion inserting into the protrusion accommodation portion, elastically deform the protrusion accommodation portion in a direction crossing the insertion direction of the mounting protrusion, and wherein the pair of restriction portion are configured to contact an outer surface of the protrusion accommodation portion so as to block the elastic deformation of the protrusion accommodation portion.

14. The appliance according to claim 13, wherein the protrusion accommodation portion includes a pair of accommodation members that extend forward and that are spaced apart from each other at an interval through which the mounting protrusion is inserted.

15. The appliance according to claim 14, wherein the mounting protrusion comprises:

an extension portion extending rearward from a rear surface of the bracket, and an insertion portion disposed at an end of the extension portion and having a width greater than a thickness of the extension portion so as to be inserted between the pair of accommodation members.

16. The appliance according to claim 15, wherein the insertion portion has a width that gradually decreases as the insertion portion protrudes rearward.

17. The appliance according to claim 15, wherein each of the pair of accommodation members comprises:

an inlet portion (i) configured to define an opening configured to receive the insertion portion and (ii) extending outward as the inlet portion extends forward, and a fixing portion disposed at a rear end of the inlet portion and having a shape corresponding to an outer surface of the insertion portion to surround the outer surface of the insertion portion.

* * * * *